US007066272B2

(12) United States Patent
Smith et al.

(10) Patent No.: US 7,066,272 B2
(45) Date of Patent: Jun. 27, 2006

(54) SEALED MULTILATERAL JUNCTION SYSTEM

(75) Inventors: Ray C. Smith, Edmonton (CA); Terry A. Schroter, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/094,719

(22) Filed: Mar. 29, 2005

(65) Prior Publication Data

US 2005/0167115 A1 Aug. 4, 2005

Related U.S. Application Data

(62) Division of application No. 10/122,424, filed on Apr. 12, 2002, now Pat. No. 6,883,611.

(51) Int. Cl.
*E21B 23/03* (2006.01)

(52) U.S. Cl. ..... 166/380; 166/50

(58) Field of Classification Search ..... 166/313, 166/381, 380, 117.5, 117.6, 50, 241.1, 206, 166/207

See application file for complete search history.

(56) References Cited

U.S. PATENT DOCUMENTS

| | | | | |
|---|---|---|---|---|
| 5,318,122 | A | 6/1994 | Murray et al. | |
| 5,338,648 | A | 8/1994 | Kojima et al. | |
| 5,458,209 | A | 10/1995 | Hayes et al. | |
| 5,615,740 | A | 4/1997 | Comeau et al. | |
| 6,070,671 | A | 6/2000 | Cumming et al. | |
| 6,073,697 | A * | 6/2000 | Parlin et al. | 166/313 |
| 6,089,320 | A | 7/2000 | LaGrange | |
| 6,092,602 | A | 7/2000 | Gano | |
| 6,241,021 | B1 | 6/2001 | Bowling | |
| 6,283,208 | B1 * | 9/2001 | George et al. | 166/255.3 |
| 6,662,886 | B1 | 12/2003 | Russell | |
| 6,679,329 | B1 * | 1/2004 | Murray et al. | 166/313 |
| 6,732,802 | B1 | 5/2004 | Smith | |
| 6,749,026 | B1 | 6/2004 | Smith et al. | |
| 2002/0157826 | A1 | 10/2002 | MacKenzie et al. | |
| 2003/0075334 | A1 * | 4/2003 | Haugen et al. | 166/313 |
| 2003/0173092 | A1 | 9/2003 | Wilson et al. | |
| 2003/0192717 | A1 | 10/2003 | Smith et al. | |
| 2004/0194971 | A1 | 10/2004 | Thomson | |

FOREIGN PATENT DOCUMENTS

| | | |
|---|---|---|
| FR | 2692316 | 12/1993 |
| GB | 2304764 | 3/1997 |
| GB | 2353811 | 3/2001 |
| GB | 2371579 | 7/2002 |
| GB | 2388136 | 11/2003 |

(Continued)

OTHER PUBLICATIONS

Search Report for U.K. application GB0501821.3.

(Continued)

*Primary Examiner*—David Bagnell
*Assistant Examiner*—Daniel P. Stephenson
(74) *Attorney, Agent, or Firm*—Marlin R. Smith

(57) ABSTRACT

A sealed multilateral junction system provides fluid isolation between intersecting wellbores in a subterranean well. In a described embodiment, a method of forming a wellbore junction includes the steps of sealing a tubular string in a branch wellbore to a tubular structure in a parent wellbore. The tubular string may be secured to the tubular structure utilizing a flange which is larger in size than a window formed in the tubular structure. The flange may be sealed to the tubular structure about the window by a metal to metal seal or by adhering the flange to the tubular structure.

41 Claims, 22 Drawing Sheets

FOREIGN PATENT DOCUMENTS

| | | |
|---|---|---|
| WO | WO 02/20941 | 3/2002 |
| WO | WO 02/059452 | 8/2002 |
| WO | WO 03/008756 | 1/2003 |

OTHER PUBLICATIONS

"HOMCO Internal Steel Liner Casing Patch", Weatherford Fishing and Rental Tool Services, dated 1995.
IADC/SPE 74496, "A New TAML Level 3 Multilateral System Improves Capabilities and Operational Efficiencies", dated 2002.
Sperry-Sun Multilateral Services Profile, "LRS-SL™ Self-Locating Lateral Re-entry System", dated 2000.
Sperry-Sun Multilateral Services Profile, "LRW-SL™ Self-Locating Lateral Re-entry Whipstock", dated 2000.
Sperry-Sun Multilateral Services Profile, "LRS™ Lateral Re-entry System", dated 2000.
Sperry-Sun Multilateral Services Profile, "WREAL™ Wireline Re-entry Alignment System", dated 2000.
Sperry-Sun Multilateral Services Profile, "TEW™ Tubing Exit Whipstock", dated 2000.
Sperry-Sun Multilateral Services Profile, "LRW™ Lateral Re-entry Whipstock", dated 2000.
Sperry-Sun Multilateral Services Profile, "TPI™ Through-Tubing Pressure Isolation Sleeve", dated 2000.
Sperry-Sun Multilateral Services Profile, "Vector Block", dated 2000.
Sperry-Sun Multilateral Services Profile, "RDS™ Re-entry Drilling System", dated 2000.
Sperry-Sun Multilateral Services Profile, "MERLIN™ Milled Exit Retrievable Multilateral System", dated 2000.
Sperry-Sun Multilateral Services Profile, "4502™/4503™ Metal Mill-Through Systems", dated 2000.
Sperry-Sun Multilateral Services Profile, "RMLS™ Retrievable Multilateral System", dated 2000.
Sperry-Sun Multilateral Services Profile, "LTBS™ Lateral Tie-Back System", dated 2000.
Sperry-Sun Multilateral Services Profile, "PACE-6™ Pressure-Actuated Casing Exit System", dated 2000.
Sperry-Sun Multilateral Services Profile, "Sperry-Sun Latch Coupling", dated 2000.
Sperry-Sun Multilateral Services Profile, "4501™ Low-Side Perforation System", dated 2000.
Sperry-Sun Multilateral Services Profile, "MSCS® Multi-String Completion System", dated 2000.
Sperry-Sun Multilateral Services Profile, "ITBS™ Isolated Tie-Back System", dated 2000.
Sperry-Sun "Multilateral Products, Services, and Solutions", dated 2000.
Search Report for United Kingdom Application No.: 0308428.2.
Office action for U.S. Appl. No. 10/767,656 dated Sep. 16, 2005.

* cited by examiner

SEALED MULTILATERAL JUNCTION SYSTEM

CROSS-REFERENCE TO RELATED APPLICATION

The present application is a division of application Ser. No. 10/122,424 filed Apr. 12, 2002 now U.S. Pat. No. 6,883,611. The disclosure of this earlier application is incorporated herein in its entirety by this reference.

BACKGROUND

The present invention relates generally to operations performed in conjunction with subterranean wells and, in an embodiment described herein, more particularly provides a method of forming sealed wellbore junctions.

Many systems have been developed for connecting intersecting wellbores in a well. Unfortunately, these systems typically involve methods which unduly restrict access to one or both of the intersecting wellbores, restrict the flow of fluids, are very complex or require very sophisticated equipment to perform, are time-consuming in that they require a large number of trips into the well, do not provide secure attachment between casing in the parent wellbore and a liner in the branch wellbore and/or do not provide a high degree of sealing between the intersecting wellbores.

For example, some wellbore junction systems rely on cement alone to provide a seal between the interior of the wellbore junction and a formation surrounding the junction. In these systems, there is no attachment between the casing in the parent wellbore and the liner in the branch wellbore, other than that provided by the cement. These systems are acceptable in some circumstances, but it would be desirable in other circumstances to be able to provide more secure attachment between the tubulars in the intersecting wellbores, and to provide more effective sealing between the tubulars.

SUMMARY

In carrying out the principles of the present invention, in accordance with an embodiment thereof, a method of forming a wellbore junction is provided which both securely attaches tubulars in intersecting wellbores and effectively seals between the tubulars. The method is straightforward and convenient in its performance, does not unduly restrict flow or access through the junction, and does not require an inordinate number of trips into the well.

In one aspect of the invention, a method is provided for forming a wellbore junction which includes a step of expanding a member within a tubular structure positioned at an intersection of two wellbores. This expansion of the member may perform several functions. For example, the expanded member may secure an end of a tubular string which extends into a branch wellbore. The expanded member may also seal to the tubular string and/or to the tubular structure.

In another aspect of the invention, the tubular string may be installed in the branch wellbore through a window formed through the tubular structure. An engagement device on the tubular string engages the tubular structure to secure the tubular string to the tubular structure. For example, the engagement device may be a flange which is larger in size than the window of the tubular structure and is prevented from passing therethrough, thereby fixing the position of the tubular string relative to the tubular structure.

In yet another aspect of the invention, a whipstock may be used to drill the branch wellbore through the window in the tubular structure. Thereafter, the whipstock is used to install the tubular string in the branch wellbore. After installation of the tubular string, the whipstock may be retrieved from the parent wellbore, thereby permitting full bore access through the wellbore junction in the parent wellbore. The tubular string may be installed and the whipstock retrieved in only a single trip into the well using a unique tool string.

In still another aspect of the invention, the window may be formed in the tubular structure prior to cementing the tubular structure in the parent wellbore. To prevent cement flow through the window, a retrievable sleeve is used inside the tubular structure. After cementing, the sleeve is retrieved from within the tubular structure.

Various types of seals may be used between various elements of the wellbore junction. For example metal to metal seals may be used, or elements of the wellbore junction may be adhesively bonded to each other, etc.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
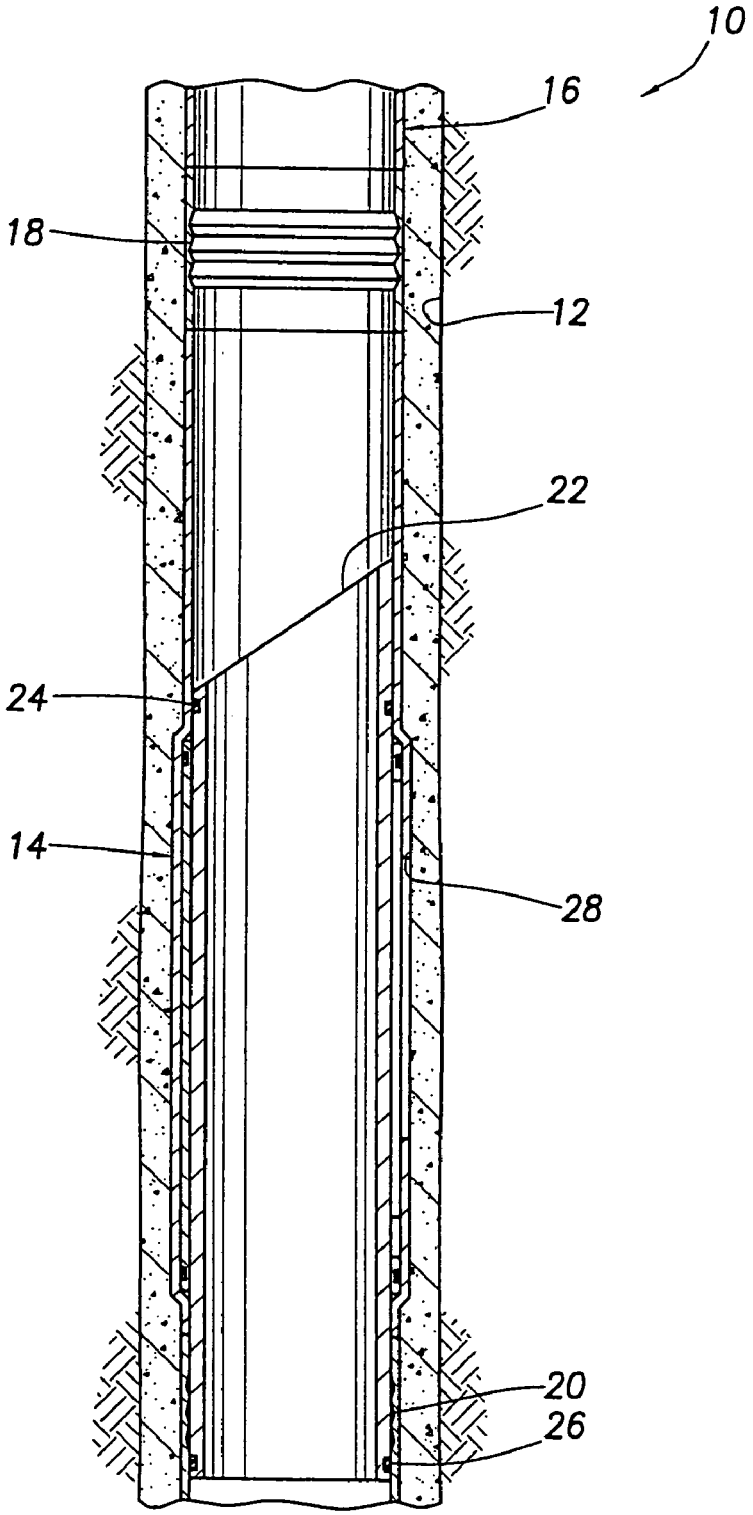
FIG. 1 is a cross-sectional view of a method of forming a wellbore junction which embodies principles of the present invention and wherein a tubular structure has been cemented within a parent wellbore.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, several steps of the method 10 have already been performed. A parent wellbore 12 has been drilled and a tubular structure 14 has been positioned in the parent wellbore. The tubular structure 14 is part of a casing string 16 used to line the parent wellbore 12.

It should be understood that use of the terms "parent wellbore" and "casing string" herein are not to be taken as limiting the invention to the particular illustrated elements of the method 10. The parent wellbore 12 could be any wellbore, such as a branch of another wellbore, and does not necessarily extend directly to the earth's surface. The casing string 16 could be any type of tubular string, such as a liner string, etc. The terms "casing string" and "liner string" are used herein to indicate tubular strings of any type, such as segmented or unsegmented tubular strings, tubular strings made of any materials, including nonmetal materials, etc. Thus, the reader will appreciate that these and other descriptive terms used herein are merely for convenience in clearly explaining the illustrated embodiments of the invention, and are not used for limiting the scope of the invention.

The casing string 16 also includes two anchoring profiles 18, 20 for purposes that are described below. The lower profile 20 may be an orienting latch profile, for example, a profile which serves to rotationally orient a device engaged therewith relative to the window 28. The upper profile 18 may also be an orienting latch profile. Such orienting profiles are well known to those skilled in the art.

A tubular shield 22 is received within the casing string 16, and seals 24, 26 carried on the shield are positioned at an upper end of the tubular structure 14 and at a lower end of the anchoring profile 20, respectively. The shield 22 is a relatively thin sleeve as depicted in FIG. 1, but it could have other shapes and other configurations in keeping with the principles of the invention.

The shield 22 serves to prevent flow through a window 28 formed laterally through a sidewall of the tubular structure 14. Specifically, the shield 22 prevents the flow of cement through the window 28 when the casing string 16 is cemented in the parent wellbore 12. The shield 22 also prevents fouling of the lower profile 20 during the cementing operation, and the shield may be releasably engaged with the profile to secure it in position during the cementing operation and to enable it to be retrieved from the casing string 16 after the cementing operation, for example, by providing an appropriate convention latch on the shield.

The shield 22 prevents cement from flowing out to the window 28 when cement is pumped through the casing string 16. Other means may be used external to the tubular structure 14 to prevent cement from flowing in to the window 28, for example, an outer membrane, a fiberglass wrap about the tubular structure, a substance filling the window and any space between the window and the shield 22, etc.

At this point it should be noted that the use of the terms "cement" and "cementing operation" herein are used to indicate any substance and any method of deploying that substance to fill the annular space between a tubular string and a wellbore, to seal between the tubular string and the wellbore and to secure the tubular string within the wellbore. Such substances may include, for example, various cementitious compositions, polymer compositions such as epoxies, foamed compositions, other types of materials, etc.

At the time the casing string 16 is positioned in the wellbore 12, but prior to the cementing operation, the tubular structure 14 is rotationally oriented so that the window 28 faces in a direction of a desired branch wellbore to extend outwardly from the window. Thus, the tubular structure 14 is positioned at the future intersection between the parent wellbore 12 and the branch wellbore-to-be-drilled, with the window 28 facing in the direction of the future branch wellbore. The rotational orientation may be accomplished in any of a variety of ways, for example, by engaging a gyroscopic device with the upper profile 18, by engaging a low side indicator with the shield 22, etc. Such rotational orienting devices (gyroscope, low side indicator, etc.) are well known to those skilled in the art.

After the tubular structure 14 is positioned in the wellbore 12 with the window 28 facing in the proper direction, the casing string 16 is cemented in place in the wellbore. When the cementing operation is concluded, the shield 22 is retrieved from the casing string 16.

Figure 2:
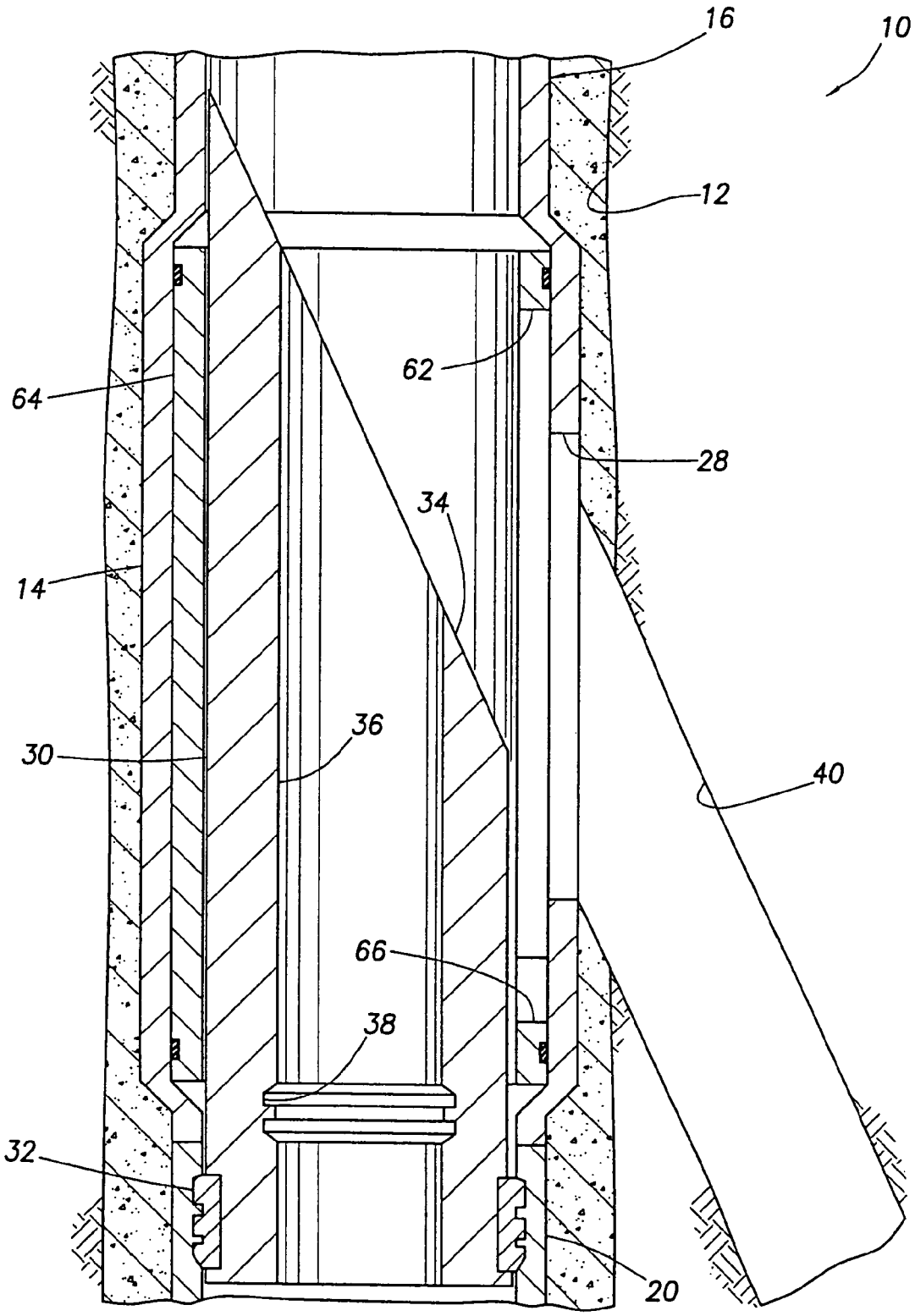
FIG. 2 is an enlarged cross-sectional view of the method wherein a branch wellbore has been drilled through the tubular structure utilizing a whipstock positioned in the tubular structure.

Referring additionally now to FIG. 2, an enlarged view of the method 10 is representatively illustrated wherein the shield 22 has been retrieved. A whipstock 30 or other type of deflection device has been installed in the tubular structure 14 by engaging keys, lugs or dogs 32 with the profile 20, thereby releasably securing the whipstock in position and rotationally aligning an upper deflection surface 34 with the window 28.

The whipstock 30 also includes an inner passage 36 and a profile 38 formed internally on the passage for retrieving the whipstock. Of course, other means for retrieving the whipstock 30 could be used, for example, a washover tool, a spear, an overshot, etc.

As depicted in FIG. 2, one or more cutting devices, such as drill bits, etc., have been deflected off of the deflection surface 34 and through the window 28 to drill a branch wellbore 40 extending outwardly from the window. As discussed above, the term "branch wellbore" should not be taken as limiting the invention, since the wellbore 40 could be a parent of another wellbore, or could be another type of wellbore, etc.

Figure 3:
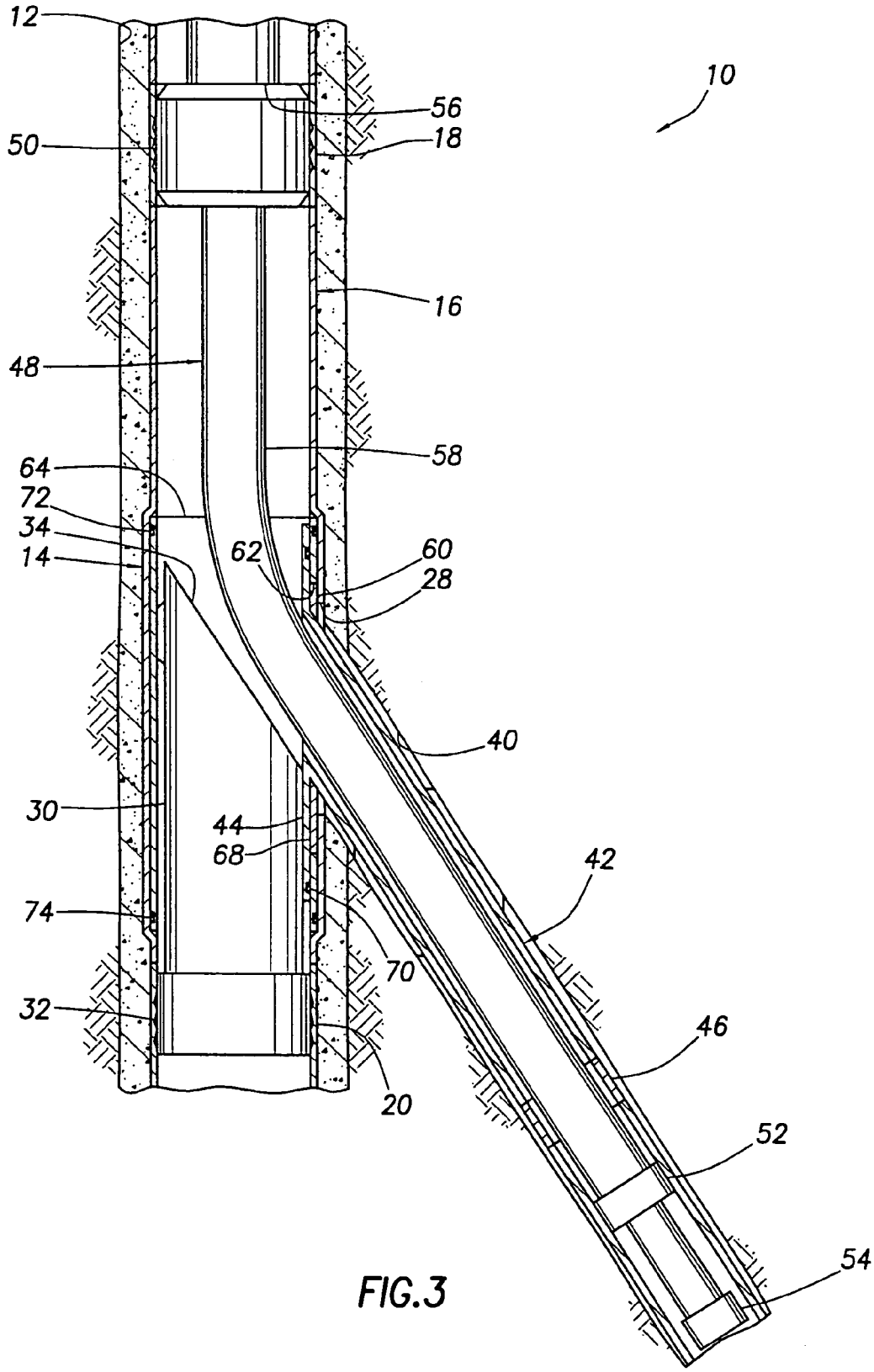
FIG. 3 is a cross-sectional view of the method wherein a tubular string is being installed in the branch wellbore.

Referring additionally now to FIG. 3, the method 10 is representatively illustrated wherein a tubular string 42 has been installed in the branch wellbore 40. The tubular string 42 may be made up substantially of liner or any other type of tubular material.

As depicted in FIG. 3, the tubular string 42 includes an engagement device 44 for engaging the tubular structure 14 and securing an upper end of the tubular string thereto. The tubular string 42 also includes a flex or swivel joint 46 for enabling, or at least enhancing, deflection of the tubular string from the parent wellbore 12 into the branch wellbore 40. Alternatively, or in addition, the swivel joint 46 permits rotation of an upper portion of the tubular string 42 relative to a lower portion of the tubular string in the rotational alignment step of the method 10 described below. The tubular string 42 is deflected off of the deflection surface 34 as it is conveyed downwardly attached to a tool string 48.

The tool string 48 includes an anchor 50 for releasable engagement with the upper profile 18, a running tool 52 for releasable attachment to the tubular string 42, and a retrieval tool 54 for retrieving the whipstock 30. The running tool 52 may include keys, lugs or dogs for engaging an internal profile (not shown) of the tubular string 42. The retrieval tool 54 may include keys, lugs or dogs for engagement with the profile 38 of the whipstock 30.

When the anchor 50 is engaged with the profile 18, the tubular string 42 is rotationally aligned so that the engagement device 44 will properly engage the tubular structure 14 as further described below. In addition, the anchor 50 is preferably spaced apart from the engagement device 44 so that when the anchor is engaged with the profile 18 and a shoulder 56 formed on a tubing string 58 of the tool string 48 contacts the anchor, the engagement device is properly positioned in engagement with the tubular structure 14.

Specifically, the tubing string 58 is slidably received within the anchor 50. When the shoulder 56 contacts the anchor 50, the engagement device 44 is a predetermined distance from the anchor. This distance between the anchor 50 and the engagement device 44 corresponds with another predetermined distance between the profile 18 and the tubular structure 14. Thus, when the tubular string 42 is being conveyed into the branch wellbore 40, the engagement device 44 will properly engage the tubular structure 14 as the shoulder 56 contacts the anchor 50.

The running tool 52 may then be released from the tubular string 42, the tool string 48 may be raised into the parent wellbore 12, and then the retrieval tool 54 may be engaged with the profile 38 in the whipstock 30 to retrieve the whipstock from the parent wellbore. Note that the installation of the tubular string 42 and the retrieval of the whipstock 30 may thus be accomplished in a single trip into the well.

The engagement device 44 is depicted in FIG. 3 as a flange which extends outwardly from the upper end of the tubular string 42. The engagement device 44 includes a backing plate or landing plate 60 which is received in an opening 62 formed through a sidewall of a guide structure 64 of the tubular structure 14. Preferably, the opening 62 is complementarily shaped relative to the plate 60, and this complementary engagement maintains the alignment between the tubular string 42 and the tubular structure 14. For example, engagement between the plate 60 and the opening 62 supports the upper end of the tubular string 42, so that an annular space exists about the upper end of the tubular string for later placement of cement therein.

The guide structure 64 is more clearly visible in the enlarged view of FIG. 2. In this view it may also be seen that the opening 62 includes an elongated slot 66 at a lower end thereof. Preferably, the plate 60 includes a downwardly extending tab 68 (see FIG. 3) which engages the slot 66 and thereby prevents rotation of the engagement device 44 relative to the window 28.

The engagement device 44 is larger in size than the window 28, and so the engagement device prevents the tubular string 42 from being conveyed too far into the branch wellbore 40. The engagement device 44 thus secures the upper end of the tubular string 42 relative to the tubular structure 14. Of course, other types of engagement devices may be used in place of the illustrated flange and backing plate, for example, an orienting profile could be formed on the tubular structure and keys, dogs or lugs could be carried on the tubular string 42 for engagement therewith to orient and secure the tubular string relative to the tubular structure.

As depicted in FIG. 3, the engagement device 44 carries a seal 70 thereon which circumscribes the opening 62 and sealingly engages the guide structure 64. The guide structure 64 carries seals 72, 74 thereon which sealingly engage above and below the window 28. Thus, the tubular string 42 is sealed to the tubular structure 14 so that leakage therebetween is prevented. The seals 70, 72, 74, or any of them, may be elastomer seals, non-elastomer seals, metal to metal seals, expanding seals, and/or seals created by adhesive bonding, such as by using epoxy or another adhesive.

Figure 4:
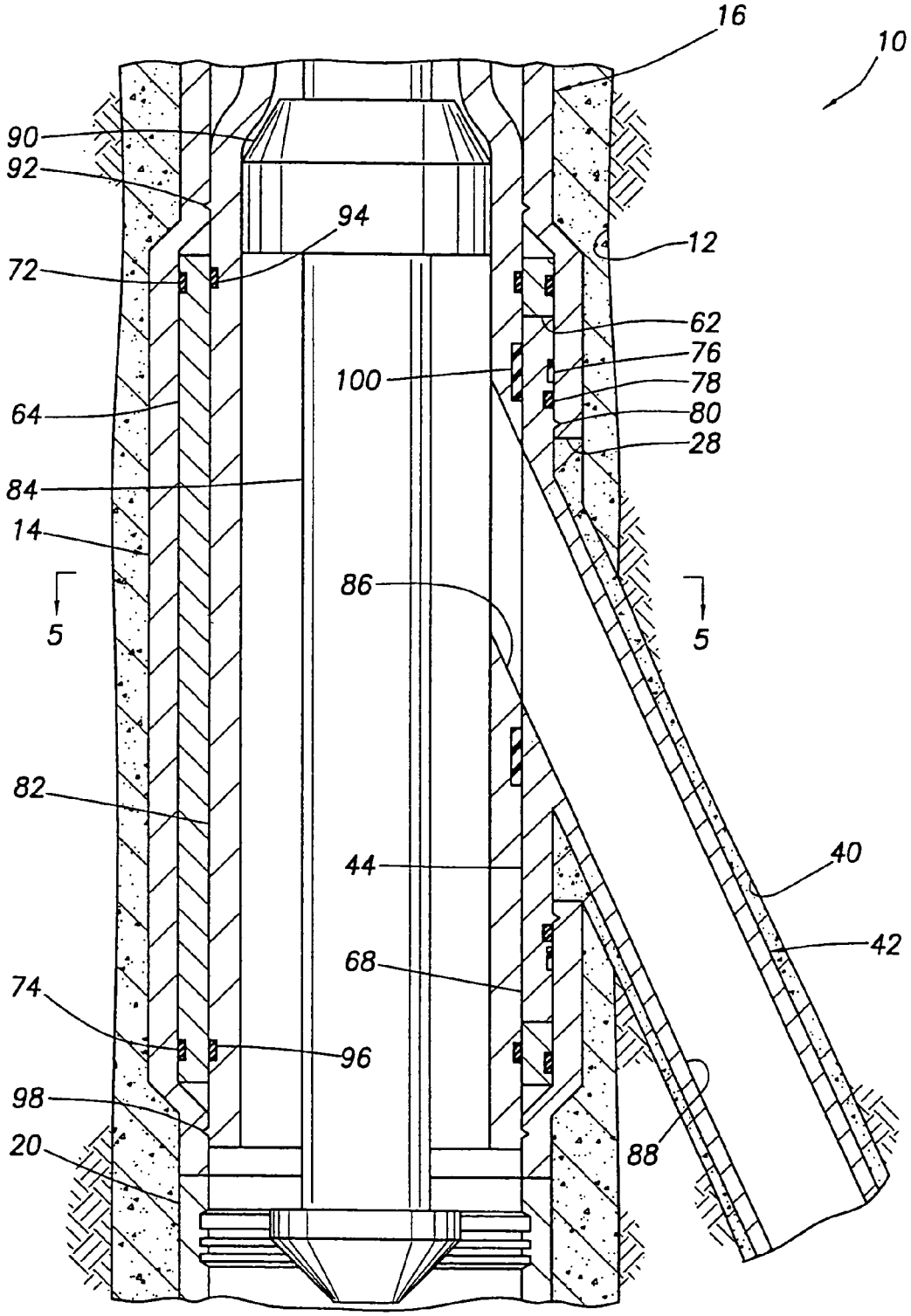
FIG. 4 is an enlarged cross-sectional view of the method wherein a sleeve is being expanded within the tubular structure to thereby secure and seal the tubular string to the tubular structure.

Referring additionally now to FIG. 4, an enlarged view is representatively illustrated of the method 10 after the tubular string 42 is installed in the branch wellbore 40 and the whipstock 30 is retrieved from the well. Note that an alternatively constructed engagement device 44 is illustrated in FIG. 4 which does not include the plate 60. Instead, the flange portion of the engagement device 44 is received in the opening 62 and the engagement device is sealed to the tubular structure 14 about the window 28 using one or more seals 76, 78, 80 circumscribing the window. The seal 76 is an adhesive, the seal 78 is an o-ring and the seal 80 is a metal to metal seal.

To further secure the tubular string 42 to the tubular structure 14, a member 82 is expanded within the tubular structure using an expansion device 84. As depicted in FIG. 4, the member 82 is a tubular sleeve having an opening 86 formed through a sidewall thereof. Of course, other expandable member shapes and configurations could be used in keeping with the principles of the invention.

The opening 86 is rotationally aligned with an internal flow passage 88 of the tubular string 42, for example, by engaging the expansion device 84 with the upper profile 18. Then, the expansion device 84 is actuated to displace a wedge or cone go upwardly through the member 82, thereby expanding the member outwardly. Such outward expansion also outwardly displaces seals 92, 94, 96, 98, 100 carried on the member.

The seals 94, 96 sealingly engage the guide structure 64 above and below the opening 62. The seals 92, 98 are metal to metal seals and sealingly engage the tubular structure 14 above and below the guide structure 64. The seal 100 is an adhesive seal which circumscribes the passage 88 and sealingly engages the flange portion of the engagement device 44. Of course, the seals 92, 94, 96, 98, 100, or any of them, may be any type of seal, for example, elastomer, non-elastomer, metal to metal, adhesive, etc.

After the member 82 is expanded, the expansion device 84 is retrieved from the well and the tubular string 42 is cemented within the branch wellbore 40. For example, a foamed composition may be injected into the annulus radially between the tubular string 42 and the branch wellbore 40. The foamed composition could expand in the annulus to fill any voids therein, and could expand to fill any voids about the structure 14 in the wellbore 12.

Note that the engagement device 44 is retained between the member 82 and the tubular structure 14, thereby preventing upward and downward displacement of the tubular string 42. In addition, where metal to metal seals are used, the expansion of the member 82 maintains a biasing force on these seals to maintain sealing engagement.

Figure 5:
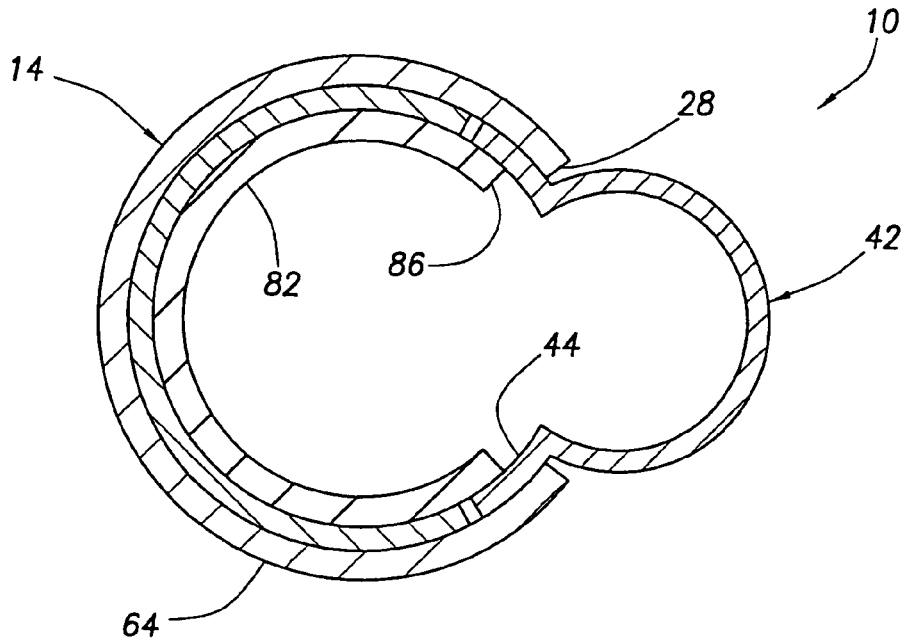
FIG. 5 is a cross-sectional view taken along line 5—5 of FIG. 4, showing the sleeve expanded within the tubular structure.

Referring additionally now to FIG. 5, a partial cross-sectional view, taken along line 5—5 of FIG. 4 is representatively illustrated. In this view, only the tubular string 42, tubular structure 14, guide structure 64 and expandable member 82 cross-sections are shown for clarity of illustration. From FIG. 5, it may be more clearly appreciated how the engagement device 44 is received in the guide structure 64, and how expansion of the member 82 secures the engagement device in the tubular structure 14.

In addition, note that no separate seals are visible in FIG. 5 for sealing between the engagement device 44 and the tubular structure 14 or expansion member 82. This is due to the fact that FIG. 5 illustrates an alternate sealing method wherein sealing between the engagement device 44 and each of the tubular structure 14 and expansion member 82 is accomplished by metal to metal contact between these elements.

Specifically, expansion of the member 82 causes it to press against an interior surface the engagement device 44 circumscribing the passage 88, which in turn causes an exterior surface of the engagement device to press against an interior surface of the tubular structure 14 circumscribing the window 28. This pressing of one element surface against another when the member 82 is expanded results in metal to metal seals being formed between the surfaces. However, as mentioned above, any type of seal may be used in keeping with the principles of the invention.

Figure 6:
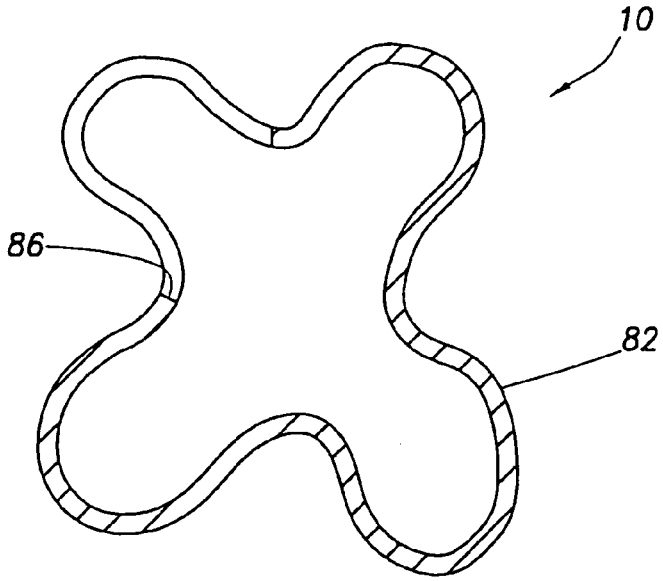
FIGS. 6 & 7 are cross-sectional views of the sleeve in its radially compressed and expanded configurations, respectively.
Figure 8:
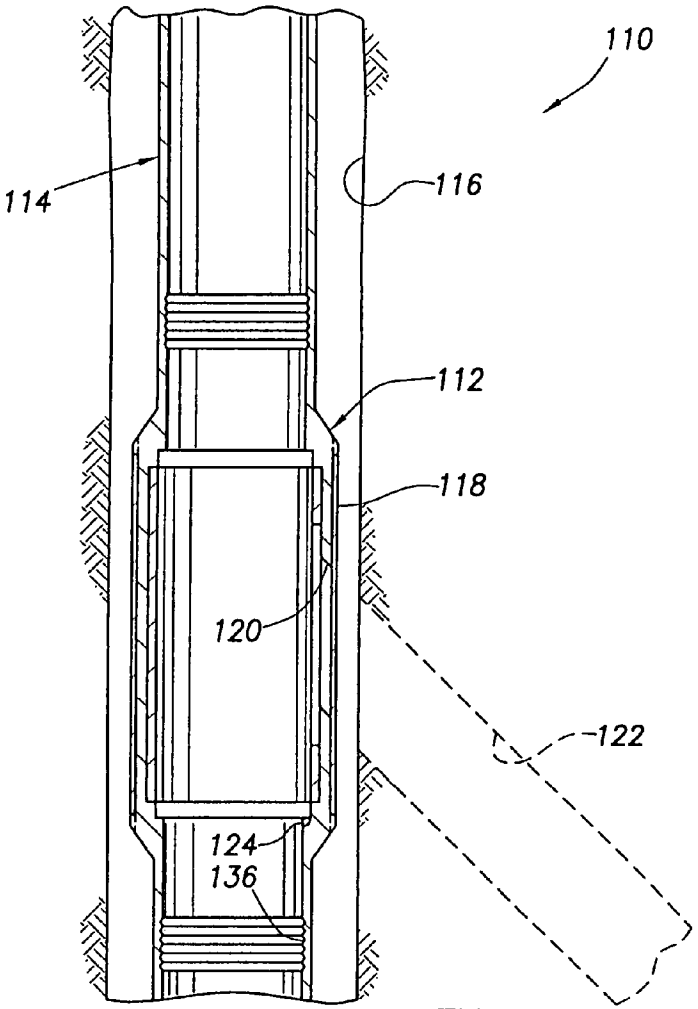
FIGS. 8–13 are cross-sectional views of a second method embodying principles of the present invention.
Figure 7:
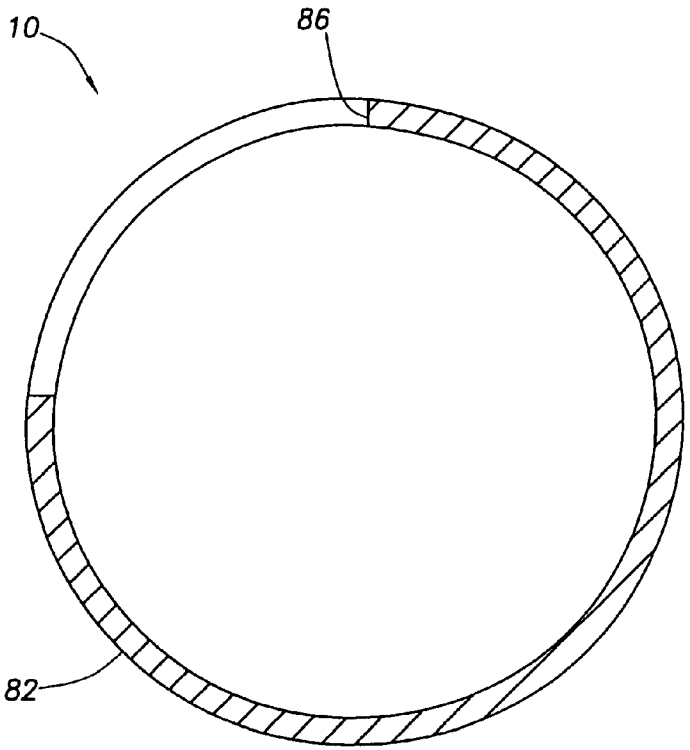

Referring additionally now to FIGS. 6 and 7, the expansion member 82 is representatively illustrated in its radially compressed and radially expanded configurations, respectively. In FIG. 6, it may be seen that the expansion member 82 in its radially compressed configuration has a circumferentially corrugated shape, that is, the member has a convoluted shape about its circumference. In FIG. 7, the member 82 is radially expanded so that it attains a substantially cylindrical tubular shape, that is, it has a substantially circular cross-sectional shape.

Referring additionally now to FIGS. 8–13, another method 110 embodying principles of the invention is representatively illustrated. In the method 110, a tubular structure 112 is interconnected in a casing string 114 and conveyed into a parent wellbore 116. The tubular structure 112 preferably includes a tubular outer shield 118 outwardly overlying a window 120 formed through a sidewall of the tubular structure. The shield 118 is preferably made of a relatively easily drilled or milled material, such as aluminum.

The shield 118 prevents cement from flowing outwardly through the window 120 when the casing string 114 is cemented in the wellbore 116. The shield 118 also transmits torque through the tubular structure 112 from above to below the window 120, due to the fact that the shield is rotationally secured to the tubular structure above and below the window, for example, by castellated engagement between upper and lower ends of the shield and the tubular structure above and below the window, respectively.

The tubular structure 112 is rotationally aligned with a branch wellbore-to-be-drilled 122, so that the window 120 faces in the radial direction of the desired branch wellbore. This rotational alignment may be accomplished, for example, by use of a conventional wireline-conveyed direction sensing tool (not shown) engaged with a key or keyway 124 having a known orientation relative to the window 120. Other rotational alignment means may be used in keeping with the principles of the invention.

Figure 9:
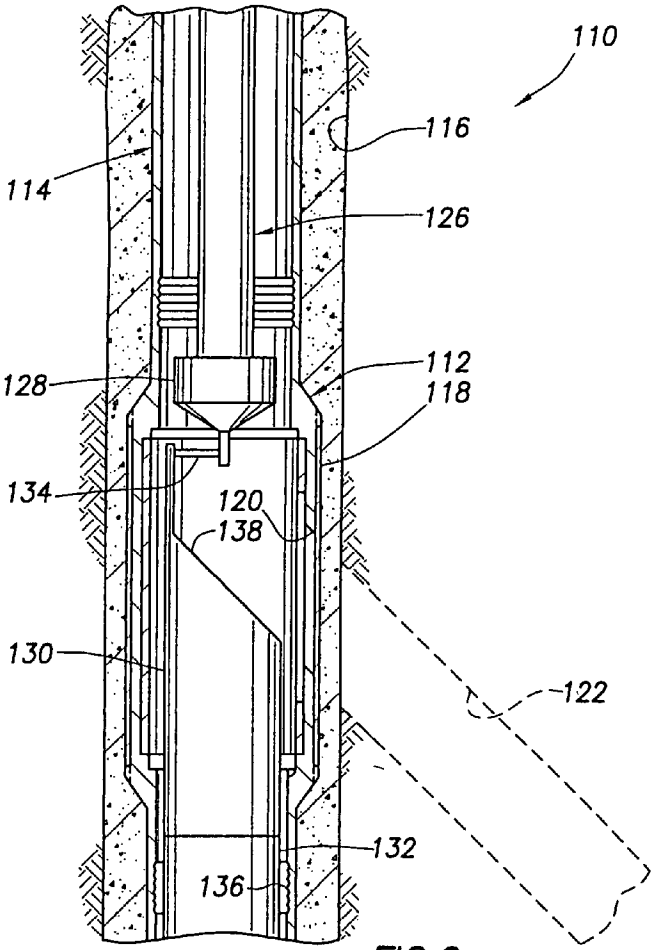

In FIG. 9 it may be seen that a work string 126 is used to convey a mill, drill or other cutting tool 128, a whipstock or other deflection device 130 and an orienting latch or anchor 132 into the casing string 114. The drill 128 is releasably attached to the whipstock 130, for example, by a shear bolt 134, thereby enabling the drill and whipstock to be conveyed into the casing string 114 in a single trip into the well.

The anchor 132 is engaged with an anchoring and orienting profile 136 in the casing string 114 below the tubular structure 112. Such engagement secures the whipstock 130 relative to the tubular structure 112 and rotationally orients the whipstock relative to the tubular structure, so that an upper inclined deflection surface 138 of the whipstock faces toward the window 120 and the desired branch wellbore 122.

Thereafter, the shear bolt 134 is sheared (for example, by slacking off on the work string 126, thereby applying a downwardly directed force to the bolt), permitting the drill 128 to be laterally deflected off of the surface 138 and through the window 120. The drill 128 is used to drill or mill outwardly through the shield 118, and to drill the branch wellbore 122. Of course, multiple cutting tools and different types of cutting tools may be used for the drill 128 during this drilling process.

As depicted in FIG. 9, the casing string 114 has been cemented within the wellbore 116 prior to the drilling process. However, it is to be clearly understood that it is not necessary for the tubular structure 112 to be cemented in the wellbore 116 at this time. It may be desirable to delay cementing of the casing string 114, or to forego cementing of the tubular structure 112, as set forth in further detail below.

Figure 10:
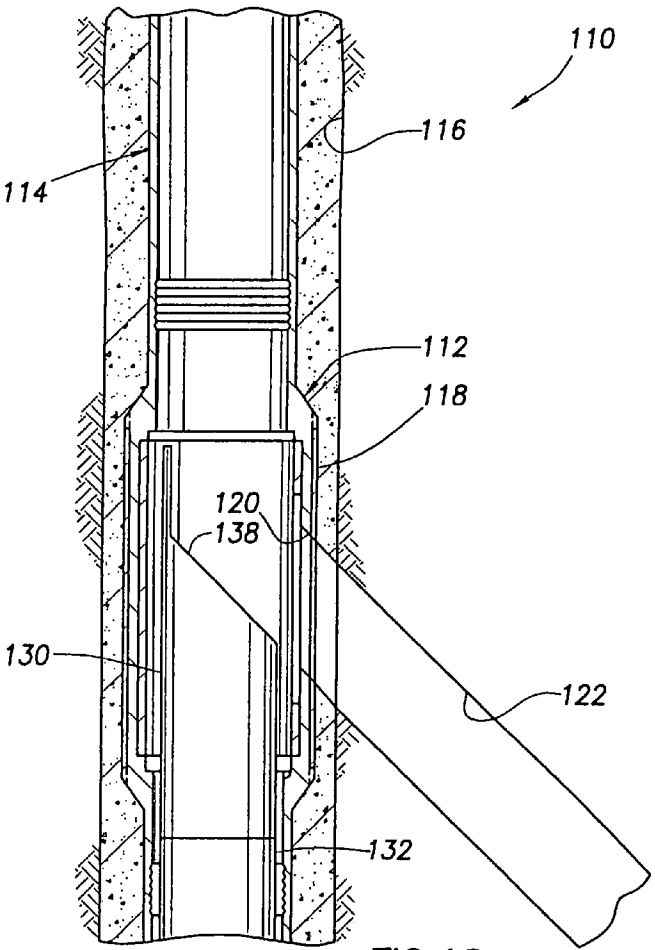

In FIG. 10 it may be seen that the branch wellbore 122 has been drilled extending outwardly from the window 120 of the tubular structure 112 by laterally deflecting one or more cutting tools from the parent wellbore 116 off of the deflection surface 138 of the whipstock 130.

Figure 11:
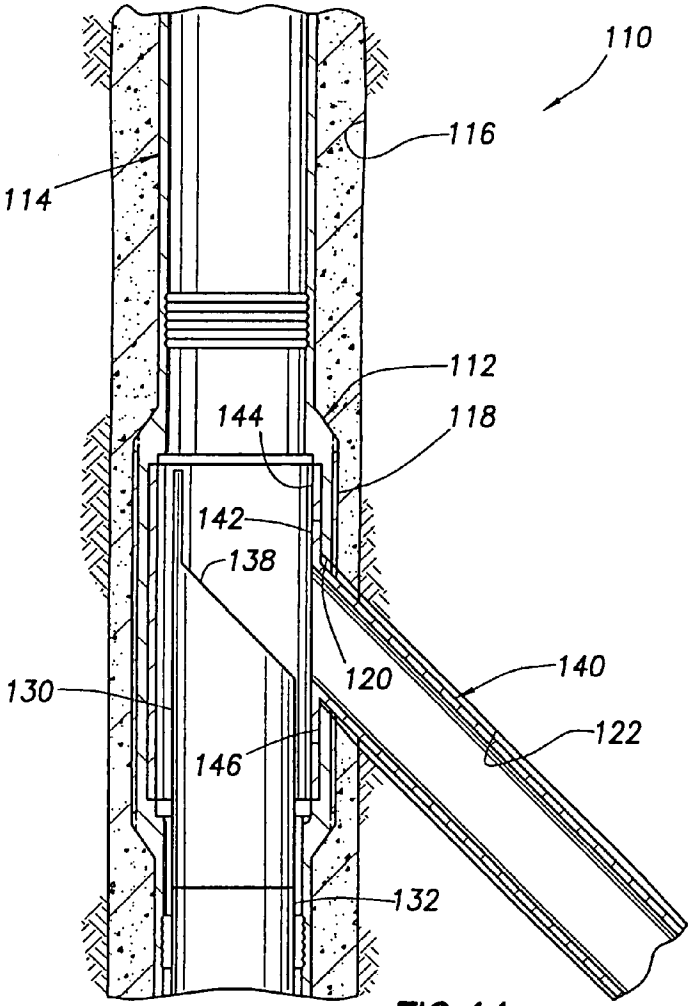
Figure 14:
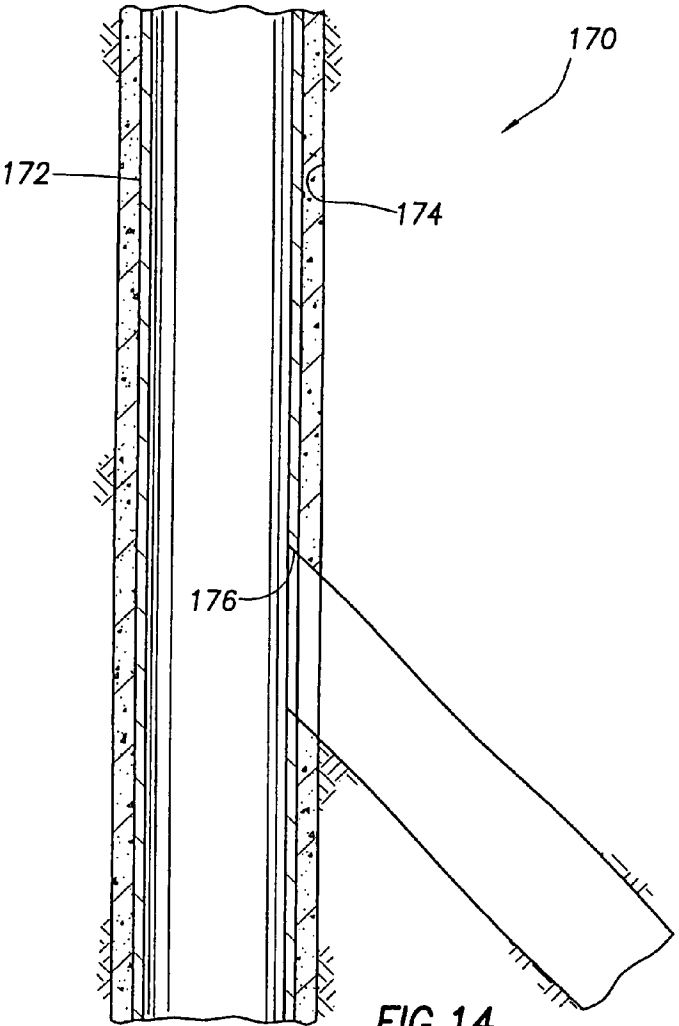
FIGS. 14–17 are cross-sectional views of a third method embodying principles of the present invention.

In FIG. 11 it may be seen that a liner string 140 is conveyed through the casing string 114, and a lower end of the liner string is laterally deflected off of the surface 138, through the window 120, and into the branch wellbore 122. An engagement device 142 attached at an upper end of the liner string 140 engages a tubular guide structure 144 of the tubular structure 112, thereby securing the upper end of the liner string to the tubular structure. This engagement between the device 142 and the structure 112 forms a load-bearing connection between the casing string 114 and the liner string 140, so that further displacement of the liner string into the branch wellbore 122 is prevented.

Engagement between the device 142 and the structure 144 may also rotationally secure the device relative to the tubular structure 112. For example, the slot 66 and tab 68 described above may be used on the device 142 and structure 144, respectively, to prevent rotation of the device in the tubular structure 112. Other types of complementary engagement, and other means of rotationally securing the device 142 relative to the tubular structure 112 may be used in keeping with the principles of the invention.

Note that the device 142 is depicted in FIG. 11 as a radially outwardly extending flange-shaped member which inwardly overlaps the perimeter of the window 120. The device 142 inwardly circumscribes the window 120 and overlaps its perimeter, so if one or both mating surfaces of the device and tubular structure 112 are provided with a suitable layer of sealing material (such as an elastomer, adhesive, relatively soft metal, etc.), a seal 146 may be formed between the device and the tubular structure due to the contact therebetween. The device 142 may be otherwise shaped, and may be otherwise sealed to the tubular structure 112 in keeping with the principles of the invention.

Figure 12:
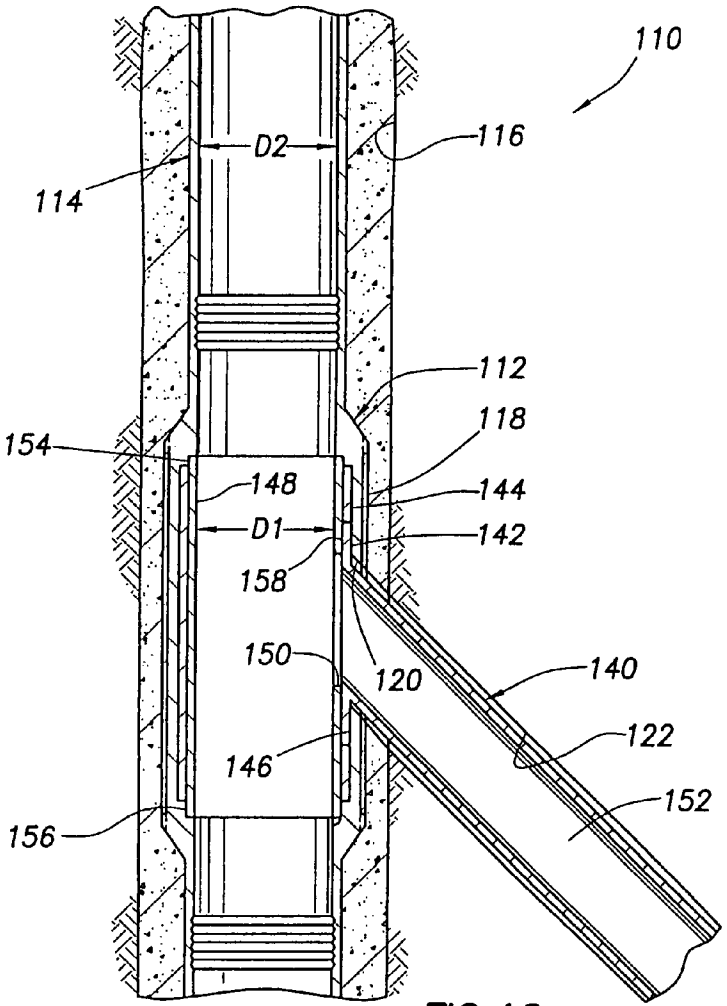

In FIG. 12 it may be seen that the whipstock 130 and anchor 132 are retrieved from the well and a generally tubular expandable member 148 is conveyed into the tubular structure 112 and expanded therein. For example, the expandable member 148 may be expanded radially outward using the expansion device 84, from a radially compressed configuration (such as that depicted in FIG. 6) to a radially extended configuration (such as that depicted in FIG. 7).

The member 148 preferably has an opening 150 formed through a sidewall thereof when it is conveyed into the structure 112. In that case, the opening 150 is preferably rotationally aligned with the window 120 (and thus rotationally aligned with an internal flow passage 152 of the liner string 140) prior to the member 148 being radially expanded. Alternatively, the member 148 could be conveyed into the structure 112 without the opening 150 having previously been formed, then expanded, and then a whipstock or other deflection device could be used to direct a cutting tool to form the opening through the sidewall of the member.

Note that the method 110 is illustrated in FIG. 12 as though the casing string 114 is cemented in the wellbore 116 at the time the member 148 is expanded in the structure 112. However, the structure 112 could be cemented in the wellbore 116 after the member 148 is expanded therein.

After being expanded radially outward, the member 148 preferably has an internal diameter D1 which is substantially equal to, or at least as great as, an internal diameter D2 of the casing string 114 above the structure 112. Thus, the member 148 does not obstruct flow or access through the structure 112.

Note that a separate seal is not depicted in FIG. 12 between the member 148 and the device 142 or the structure 112. Instead, seals 154, 156 between the member 148 and the structure 112 above and below the guide structure 144 are formed by contact between the member 148 and the structure 112 when the member is expanded radially outward. For example, one or both mating surfaces of the member 148 and tubular structure 112 may be provided with a suitable layer of sealing material (such as an elastomer, adhesive, relatively soft metal, etc.), so that the seals 154, 156 are formed between the member and the tubular structure due to the contact therebetween. The member 148 may be otherwise sealed to the tubular structure 112 in keeping with the principles of the invention.

To enhance sealing contact between the member 148 and the structure 112 and/or to ensure sufficient forming of the internal diameter D1, the structure may be expanded radially outward somewhat at the time the member is expanded radially outward, for example, by the expansion device 84. This technique may produce some outward elastic deformation in the structure 112, so that after the expansion process the structure will be biased radially inward to increase the surface contact pressure between the structure and the member 148. Such an expansion technique may be particularly useful where it is desired for the seals 154, 156 to be metal to metal seals. If this expansion technique is used, it may be desirable to delay cementing the structure 112 in the wellbore 116 until after the expansion process is completed.

Similarly, a seal 158 between the member 148 and the device 142 outwardly circumscribing the opening 150 is formed by contact between the member 148 and the device when the member is expanded radially outward. For example, one or both mating surfaces of the member 148 and device 142 may be provided with a suitable layer of sealing material (such as an elastomer, adhesive, relatively soft metal, etc.), so that the seal 158 is formed between the member and the device due to the contact therebetween. The member 148 may be otherwise sealed to the device 142 in keeping with the principles of the invention. Radially outward deformation of the structure 112 at the time the member 148 is expanded radially outward (as described above) may also enhance sealing contact between the member and the device 142, particularly where the seal 158 is a metal to metal seal.

The expandable member 148 secures the device 142 in its engagement with the guide structure 144. It will be readily appreciated that inward displacement of the device 142 is not permitted after the member 148 has been expanded. Furthermore, in the event that the device 142 has not yet fully engaged the guide structure 144 at the time the member 148 is expanded (for example, the device could be somewhat inwardly disposed relative to the guide structure), expansion of the member will ensure that the device is fully engaged with the guide structure (for example, by outwardly displacing the device somewhat).

Figure 13:
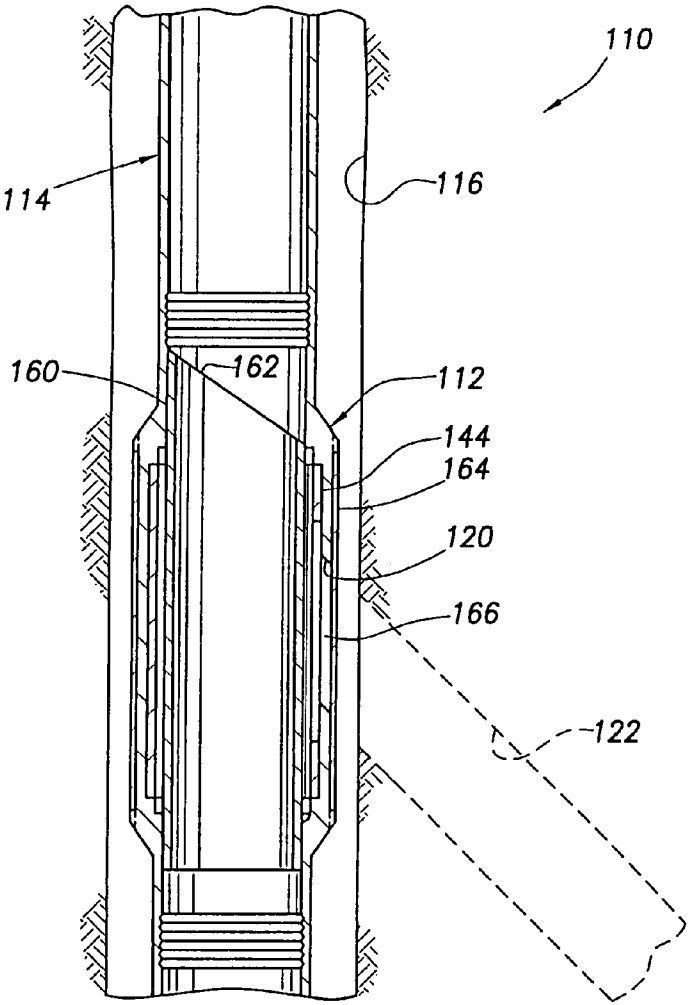

Referring additionally now to FIG. 13, an alternate procedure for use in the method 110 is representatively illustrated. This alternate procedure may be compared to the illustration provided in FIG. 8. Instead of the outer shield 118, the procedure illustrated in FIG. 13 uses an inner generally tubular shield 160 having an inclined upper surface or muleshoe 162. Although no separate seals are shown in FIG. 13, the inner shield 160 is preferably sealed to the tubular structure 112 above and below the guide structure 144, so that cement or debris in the casing string 114 is not permitted to flow into the window 120 from the interior of the structure 112. Preferably, the inner shield 160 is made of metal and is retrievable from within the structure 112 after the cementing process.

To prevent cement or debris from flowing into the structure 112 through the window 120, a generally tubular outer shield 164 outwardly overlies the window. Preferably, the outer shield 164 is made of a relatively easily drillable material, such as a composite material (e.g., fiberglass, etc.). A fluid 166 having a relatively high viscosity is contained between the inner and outer shields 162, 164 to provide support for the outer shield against external pressure, and to aid in preventing leakage of external fluids into the area between the shields. A suitable fluid for use as the fluid 166 is known by the trade name GLCOGEL, a relatively high viscosity fluid.

The muleshoe 162 provides a convenient surface for engagement by a conventional wireline-conveyed orienting tool (not shown). Such a tool may be engaged with the muleshoe 162 and used to rotationally orient the structure 112 relative to the branch wellbore-to-be-drilled 122, since the muleshoe has a known radial orientation relative to the window 120.

After the structure 112 has been appropriately rotationally oriented, the casing string 114 may be cemented in the wellbore 116, and the inner shield 160 may then be retrieved from the well. After retrieval of the inner shield 160, the method 110 may proceed as described above, i.e., the whipstock 130 and anchor 132 may be installed, etc. Alternatively, the inner shield 160 may be retrieved prior to cementing the structure 112 in the wellbore 116.

Referring additionally now to FIGS. 14–17, another method 170 embodying principles of the invention is representatively illustrated. The method 170 differs from the other methods described above in substantial part in that a specially constructed tubular structure is not necessarily used in a casing string 172 to provide a window through a sidewall of the string. Instead, a window 176 is formed through a sidewall of the casing string 172 using conventional means, such as by use of a conventional whipstock (not shown) anchored and oriented in the casing string according to conventional practice.

One of the many benefits of the method 170 is that it may be used in existing wells wherein casing has already been installed. Furthermore, the method 170 may even be performed in wells in which the window 176 has already been formed in the casing string 172. However, it is to be clearly understood that it is not necessary for the method 170 to be performed in a well wherein existing casing has already been cemented in place. The method 170 may be performed in newly drilled or previously uncased wells, and in wells in which the casing has not yet been cemented in place.

Figure 15:
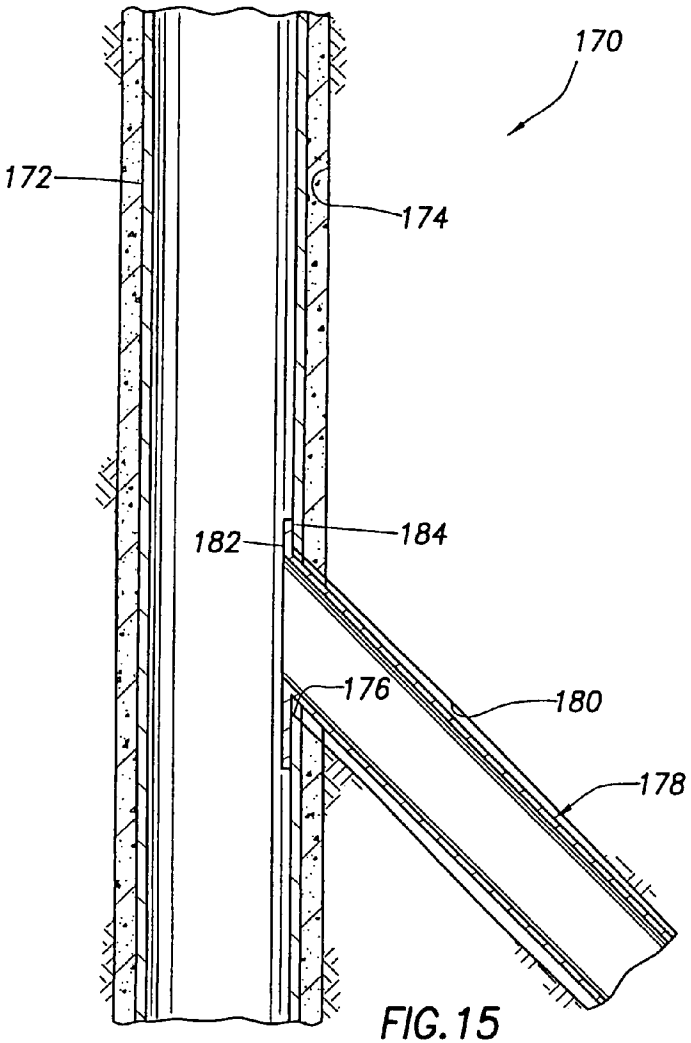

In FIG. 15 it may be seen that a liner string 178 is conveyed into a branch wellbore 180 which has been drilled extending outwardly from the window 176. At its upper end, the liner string 178 includes an engagement device 182 which engages the interior of the casing string 172 and prevents further displacement of the liner string 178 into the branch wellbore 180. Engagement of the device 182 with the casing string 172 may also rotationally align the device with respect to the casing string.

As depicted in FIG. 15, the device 182 is a flange extending outwardly from the remainder of the liner string 178. The device 182 inwardly overlies the perimeter of the window 176 and circumscribes the window. Contact between an outer surface of the device 182 and an inner surface of the casing string 172 may be used to provide a seal 184 therebetween, for example, if one or both of the inner and outer surfaces is provided with a layer of a suitable sealing material, such as an elastomer, adhesive or a relatively soft metal, etc. Thus, the seal 184 may be a metal to metal seal. Other types of seals may be used in keeping with the principles of the invention.

In an optional procedure of the method 170, the liner string 178 (or at least the device 182) may be in a radially compressed configuration (such as that depicted in FIG. 6) when it is initially installed in the branch wellbore 180, and then extended to a radially expanded configuration (such as that depicted in FIG. 7) thereafter. This expansion of the liner string 178, or at least expansion of the device 182, may be used to bring the device into sealing contact with the casing string 172.

Figure 16:
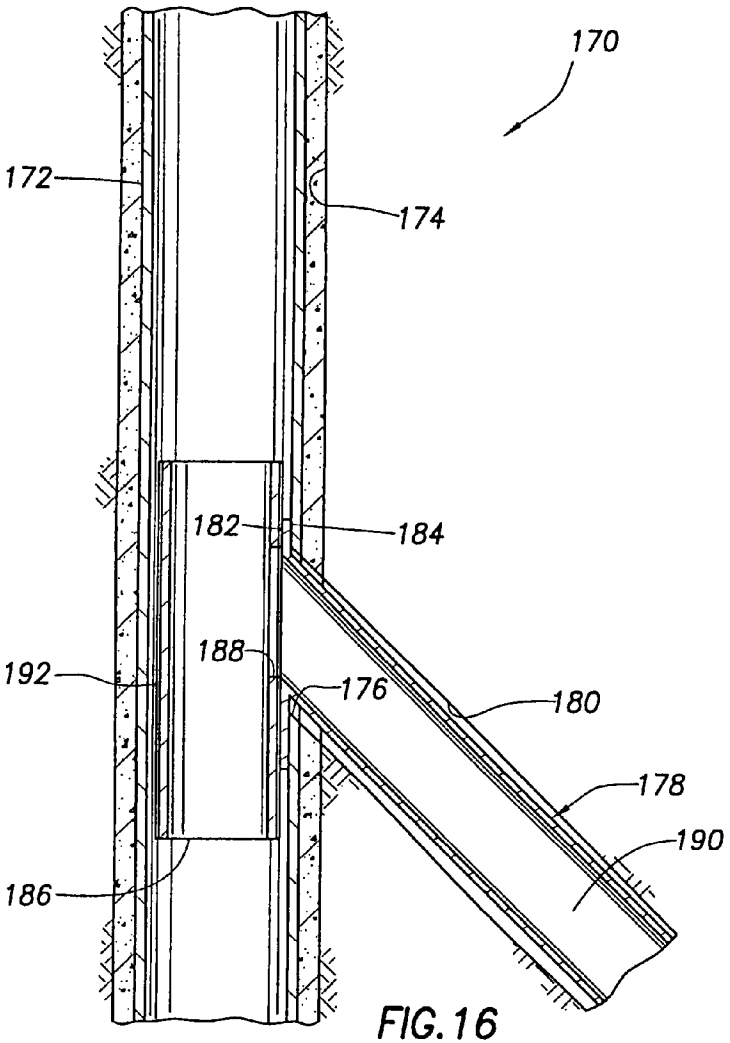

In FIG. 16 it may be seen that a generally tubular expandable member 186 is conveyed into the casing string 172 and aligned longitudinally with the device 182. The member 186 has an opening 188 formed through a sidewall thereof. The opening 188 is rotationally aligned with the window 176 (and thus aligned with a flow passage 190 of the liner string 178).

However, it is not necessary for the opening 188 to be formed in the member 186 prior to conveying the member into the well, or for the opening to be aligned with the window 176 at the time it is positioned opposite the device 182. For example, the opening 188 could be formed after the member 186 is installed in the casing string 172, such as by using a whipstock or other deflection device to direct a cutting tool to cut the opening laterally through the sidewall of the member.

As depicted in FIG. 16, the member 186 has an outer layer of a suitable sealing material 192 thereon. The sealing material 192 may be any type of material which may be used to form a seal between surfaces brought into contact with each other. For example, the sealing material 192 may be an elastomer, adhesive or relatively soft metal, etc. Other types of seals may be used in keeping with the principles of the invention.

Figure 17:
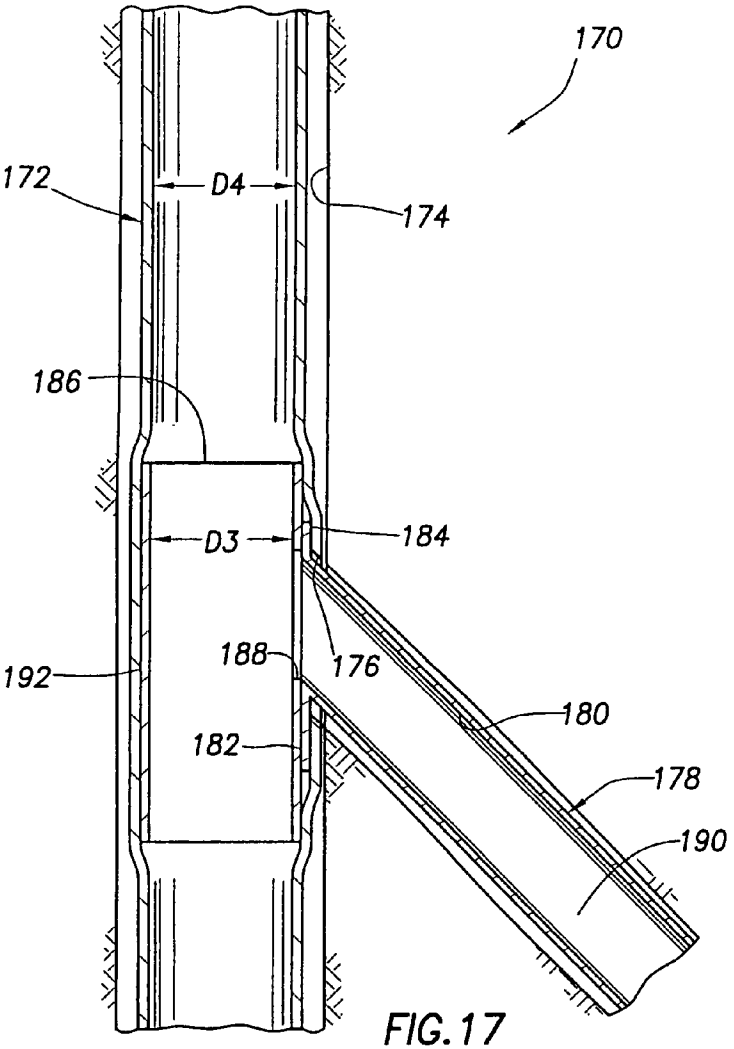

In FIG. 17 it may be seen that the member 186 is expanded radially outward, so that it now contacts the interior of the casing string 172 and the device 182. Preferably, such contact results in sealing engagement between the member 186 and the interior surface of the casing string 172, and between the member and the device 182.

Specifically, the sealing material 192 seals between the member 186 and the casing string 172 above, below and circumscribing the device 182. The sealing material 192 also seals between the member 186 and the device 182 around the outer periphery of the opening 188, that is, sealing engagement between the device 182 and the member 186 circumscribes the opening 188. Thus, the interiors of the casing and liner strings 172, 178 are completely isolated from the wellbores 174, 180 external to the strings. This substantial benefit of the method 170 is also provided by the other methods described herein.

As depicted in FIG. 17, the casing string 172 is outwardly deformed when the member 186 is radially outwardly expanded therein. At least some elastic deformation, and possibly some plastic deformation, of the casing string 172 outwardly overlying the member 186 is experienced, thereby recessing the member into the interior wall of the casing string.

As a result, the inner diameter D3 of the member 186 is substantially equal to, or at least as great as, the inner diameter D4 of the casing string 172 above the window 176. Preferably, during the expansion process, the inner diameter D3 of the member 186 is enlarged until it is greater than the inner diameter D4 of the casing string 172, so that after the expansion force is removed, the diameter D3 will relax to a dimension no less than the diameter D4.

Thus, the method 170 does not result in substantial restriction of flow or access through the casing string 172. This substantial benefit of the method 170 is also provided by other methods described herein.

Outward elastic deformation of the casing string 172 in the portions thereof overlying the member 186 is desirable in that it inwardly biases the casing string, increasing the contact pressure between the mating surfaces of the member and the casing string, thereby enhancing the seal therebetween, after the member has been expanded. However, it is to be clearly understood that it is not necessary, in keeping with the principles of the invention, for the casing string 172 to be outwardly deformed, since the member 186 may be expanded radially outward into sealing contact with the interior surface of the casing string without deforming the casing string at all.

When the member 186 is expanded, it also outwardly displaces the device 182. This outward displacement of the device 182 further outwardly deforms the casing string 172 where it overlies the device. Elastic deformation of the casing string 172 overlying the device 182 is desirable in that it results in inward biasing of the casing string when the expansion force is removed. This enhances the seal 184 between the device 182 and the casing string 172, and further increases the contact pressure on the sealing material between the device 182 and the member 186.

The method 170 is depicted in FIG. 17 as though the casing string 172 is not yet cemented in the parent wellbore 174 at the time the member 186 is expanded therein. This alternate order of steps in the method 170 may be desirable in that it may facilitate outward deformation of the casing string 172 above and below the window 176. The casing and/or liner strings 172, 178 may be cemented in the respective wellbores 174, 180 after the member 186 is expanded.

Figure 18:
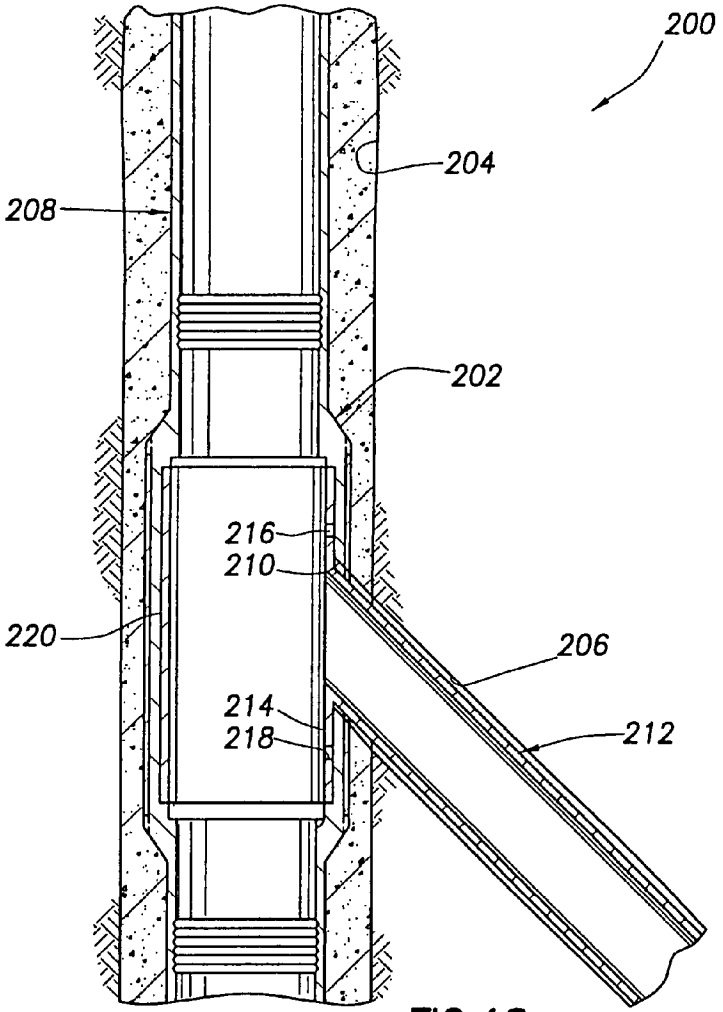
FIGS. 18–20 are cross-sectional views of a fourth method embodying principles of the present invention.
Figure 20:
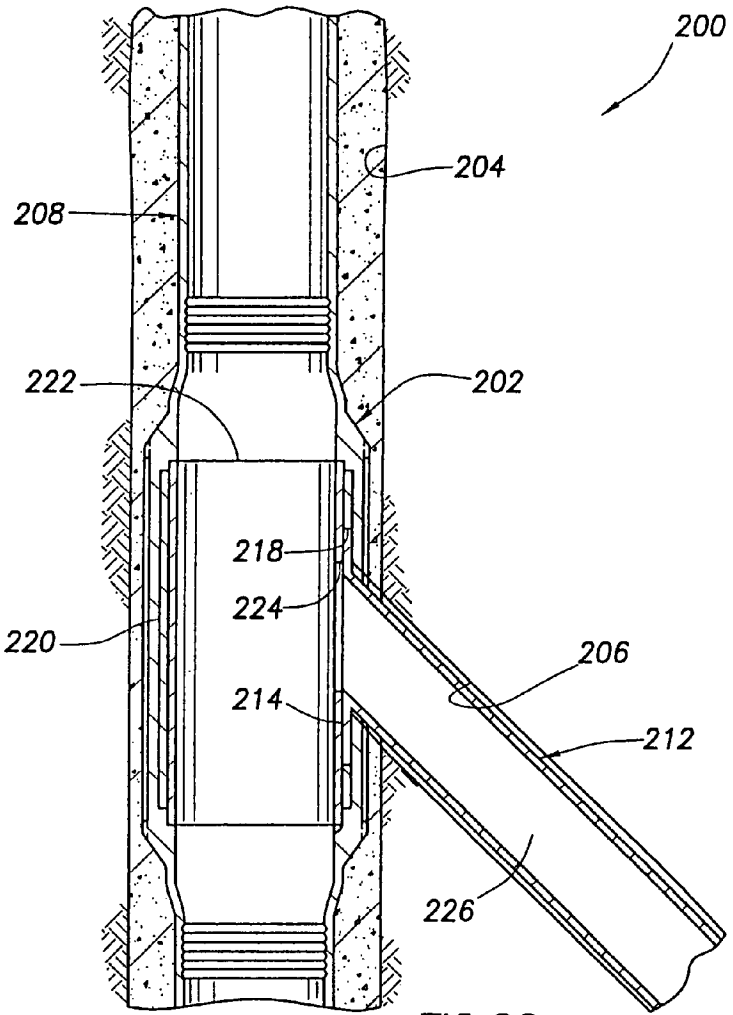
Figure 19:
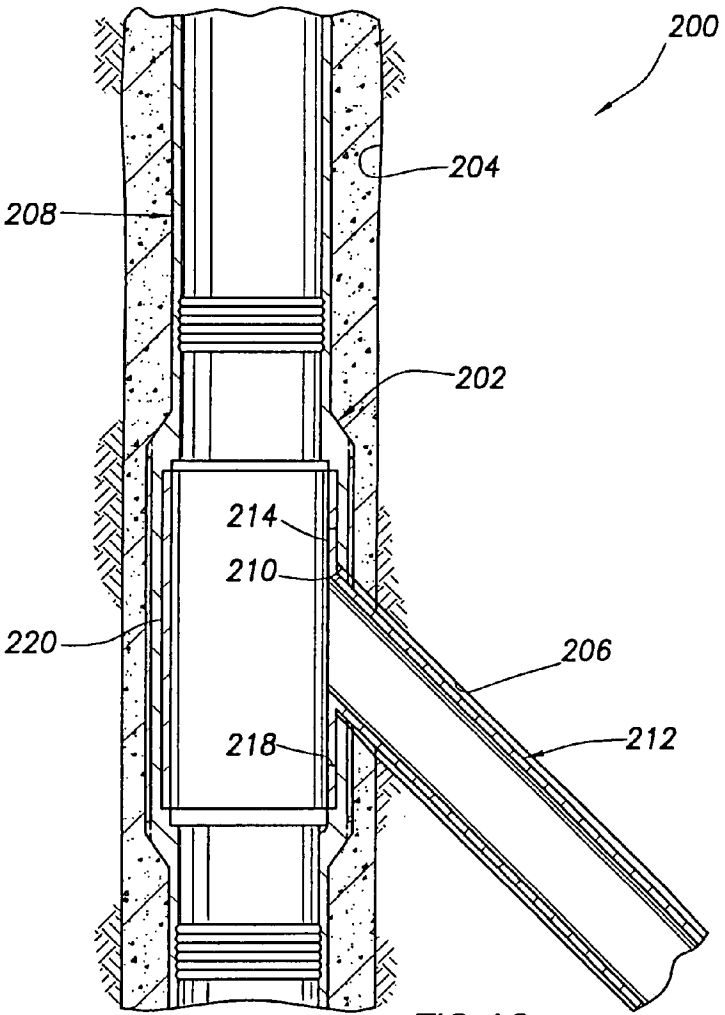

Referring additionally now to FIGS. 18–20, another method 200 embodying principles of the invention is representatively illustrated. In FIG. 18 it may be seen that a tubular structure 202 is cemented in a parent wellbore 204 at an intersection with a branch wellbore 206. However, it is not necessary for the tubular structure 202 to be cemented in the wellbore 204 until later in the method 200, if at all.

The structure 202 is interconnected in a casing string 208. The casing string 208 is rotationally oriented in the wellbore 204 so that a window 210 formed through a sidewall of the structure 202 is aligned with the branch wellbore 206. Note that the window may be formed through the sidewall of the structure 202, and that the branch wellbore 206 may be drilled, either before or after the structure is conveyed into the wellbore 204.

A liner string 212 is conveyed into the branch wellbore 206 in a radially compressed configuration. Even though it is radially compressed, a flange-shaped engagement device 214 at an upper end of the liner string 212 is larger than the window 210, and so the device prevents further displacement of the liner string into the wellbore 206. Preferably, this engagement between the device 214 and the structure 202 is sufficiently load-bearing so that it may support the liner string 212 in the wellbore 206.

An annular space 216 is provided radially between the device 214 and an opening 218 formed through the sidewall of a guide structure 220. When the liner string 212 is expanded, the device 214 deforms radially outwardly into the annular space 216. The liner string 212 is shown in its expanded configuration in FIG. 19.

As depicted in FIG. 20, a generally tubular expandable member 222 is radially outwardly expanded within the structure 202. An opening 224 formed through a sidewall of the member 222 is rotationally aligned with a flow passage of the liner string 212. The opening 224 may be formed before or after the member 222 is expanded.

Preferably, this expansion of the member 222 seals between the outer surface of the member and the inner surface of the structure 202 above and below the guide structure 220, and seals between the member and the device 214. Thus, the interiors of the casing and liner strings 208, 212 are isolated from the wellbores 204, 206 external to the strings. Alternatively, or in addition, a seal may be formed between the device 214 and the structure 202 circumscribing the window 210 where the structure outwardly overlies the device.

Preferably the seals obtained by expansion of the member 222 are due to surface contact between elements, at least one of which is displaced in the expansion process. For example, one of both of the member 222 and structure 202 may have a layer of sealing material (e.g., a layer of elastomer, adhesive, or soft metal, etc.) thereon which is brought into contact with the other element when the member is expanded. Metal to metal seals are preferred, although other types of seals may be used in keeping with the principles of the invention.

As depicted in FIG. 20, the tubular structure 202, and the casing string 208 somewhat above and below the structure, are radially outwardly expanded when the member 222 is expanded. This optional step in the method 200 may be desirable to enhance access and/or flow through the structure 202, enhance sealing contact between any of the member 222, device 214, structure 202, etc. If the casing string 208 is outwardly deformed in the method 200, it may be desirable to cement the casing string in the wellbore 204 after the expansion process is completed.

Figure 21:
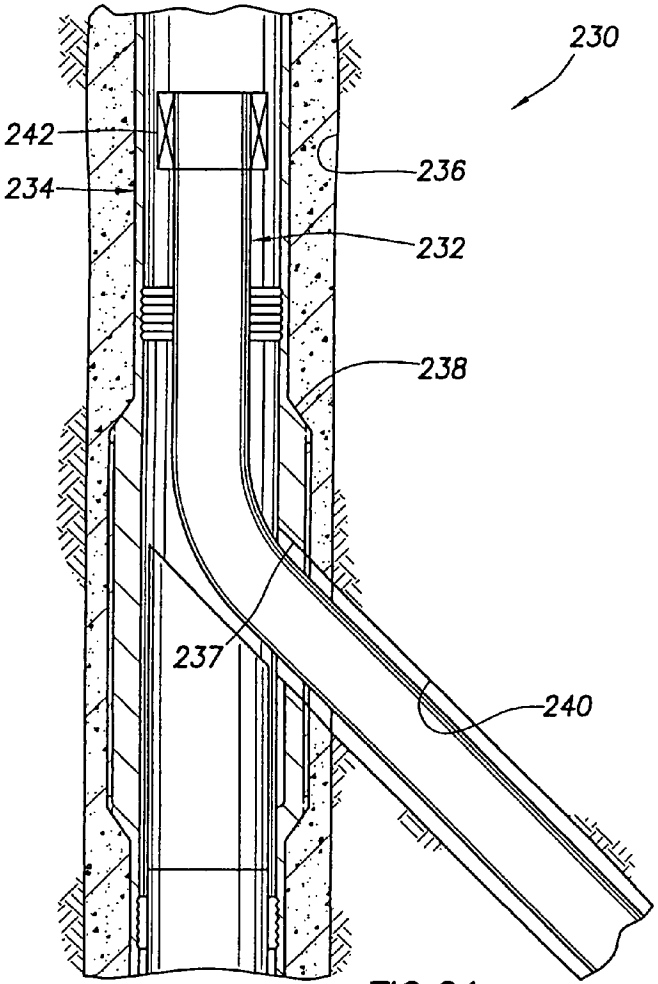
Figure 24:
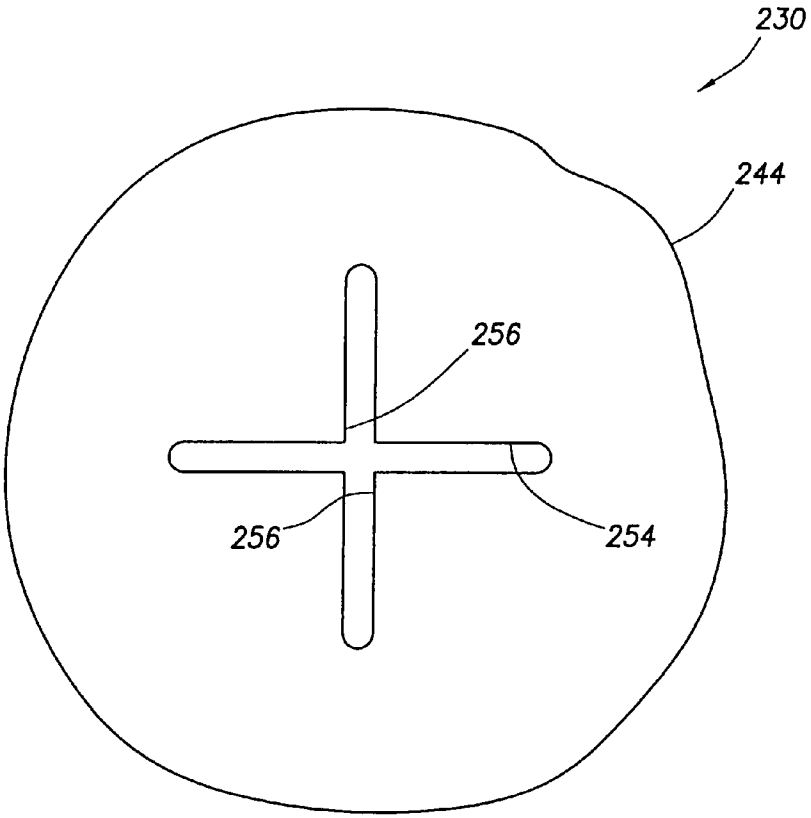

Referring additionally now to FIGS. 21–25 another method 230 embodying principles of the invention is representatively illustrated. As depicted in FIG. 21, an expandable liner string 232 is conveyed through a casing string 234 positioned in a parent wellbore 236. A lower end of the liner string 232 is deflected laterally through a window 237 formed through a sidewall of a tubular structure 238 interconnected in the casing string 234, and into a branch wellbore 240 extending outwardly from the window.

An expandable liner hanger 242 is connected at an upper end of the liner string 232. The liner hanger 242 is positioned within the casing string 234 above the window 237.

Figure 22:
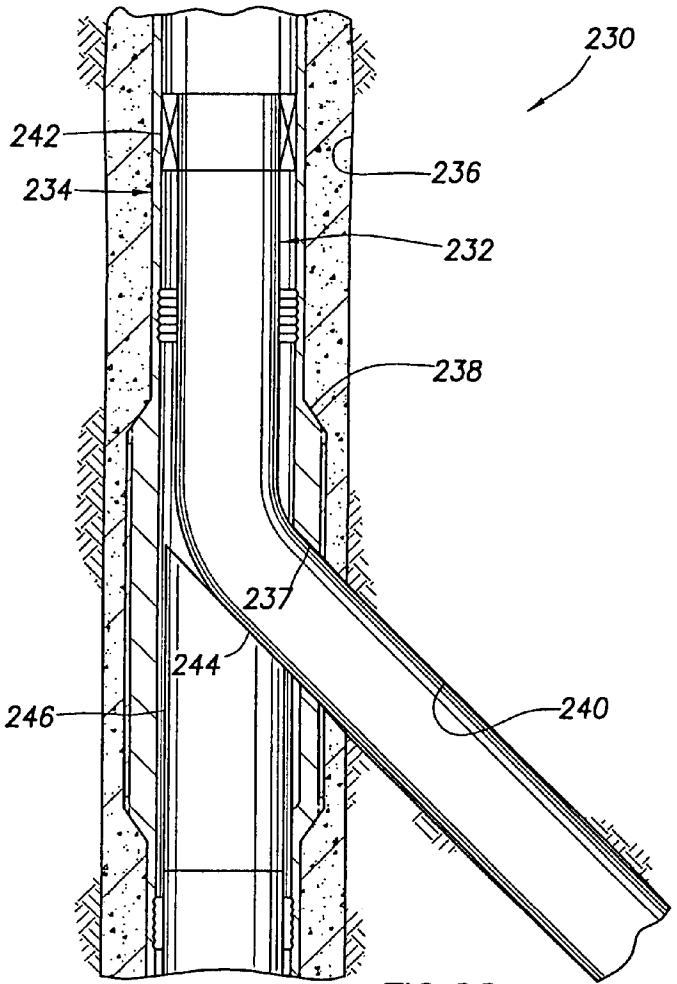
FIGS. 21–25 are cross-sectional views of a fifth method embodying principles of the present invention.

The liner string 232 is then expanded radially outward as depicted in FIG. 22. As a result of this expansion process, the liner hanger 242 sealingly engages between the liner string 232 and the casing string 234, and anchors the liner string relative to the casing string. Another result of the expansion process is that a seal is formed between the liner string and the window 237 of the structure 238. Thus, the interiors of the casing and liner strings 232, 234 are isolated from the wellbores 236, 240 external to the strings. The seal formed between the liner string 232 and the window 237 is preferably a metal to metal seal, although other types of seals may be used in keeping with the principles of the invention.

Figure 23:
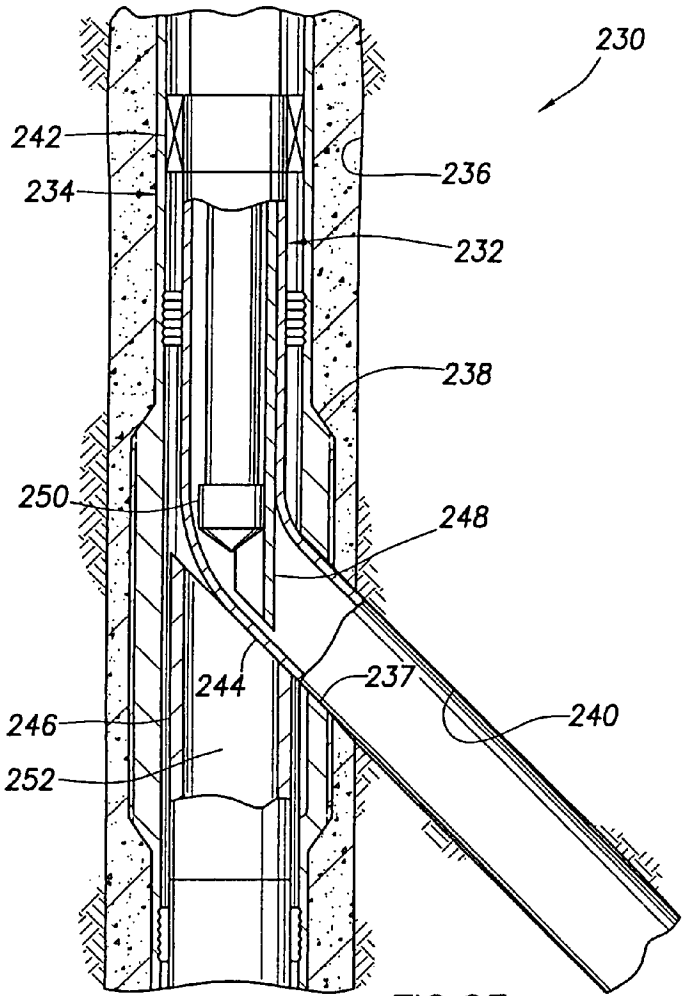

A portion 244 of the liner string 232 extends laterally across the interior of the casing string 234 above a deflection device 246 positioned below the window 237. As depicted in FIG. 23, a milling or drilling guide 248 is used to guide a drill, mill or other cutting tool 250 to cut through the sidewall of the liner string 232 at the portion 244 above the deflection device 246. In this manner, access and flow between the casing string 234 above and below the liner portion 244 through an internal flow passage 252 of the deflection device 246 is provided.

Alternatively, the liner portion 244 may have an opening 254 formed therethrough. The opening 254 may be formed, for example, by waterjet cutting through the sidewall of the liner string 232. The opening 254 may be formed before or after the liner string 232 is conveyed into the well.

Figure 25:
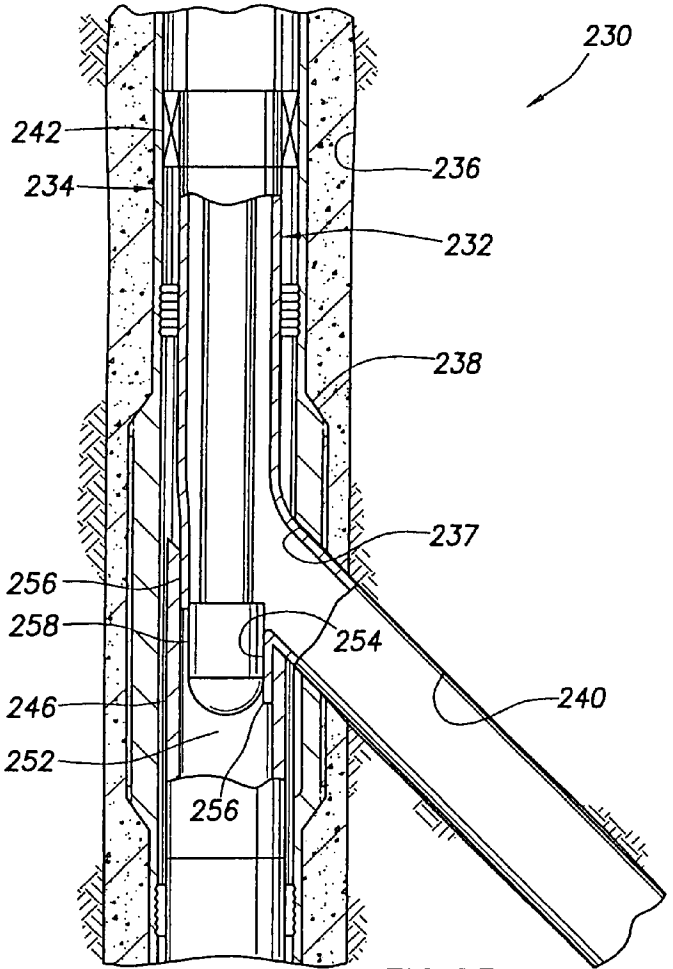

Preferably, the opening 254 is formed with a configuration such that it has multiple flaps or inward projections 256 which may be folded to increase the inner dimension of the opening, e.g., to enlarge the opening for enhanced access and flow therethrough. As depicted in FIG. 25, the projections 256 are folded over by use of a drift or punch 258, thereby enlarging the opening 254 through the liner portion 244.

The projections 256 are thus displaced into the passage 252 of the deflection device 246 below the liner string 232. A seal may be formed between the liner portion 244 and the deflection device 246 circumscribing the opening 254 in this process of deforming the projections 256 downward into the passage 252. Preferably, the seal is due to metal to metal contact between the liner portion 244 and the deflection device 246, but other types of seals may be used in keeping with the principles of the invention.

Figure 26:
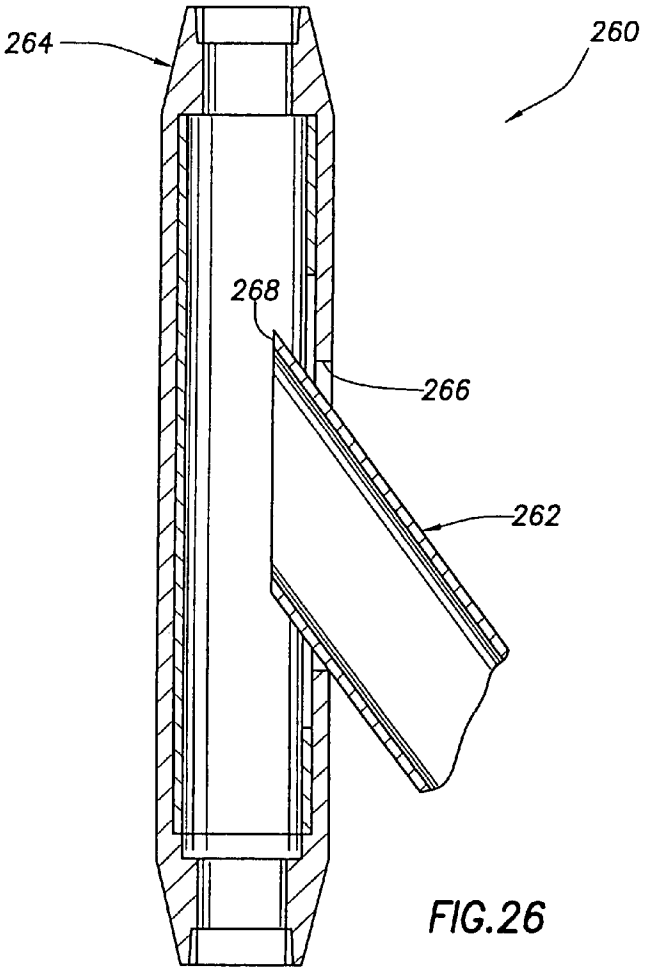
FIGS. 26 & 27 are cross-sectional views of a sixth method embodying principles of the present invention.
Figure 27:
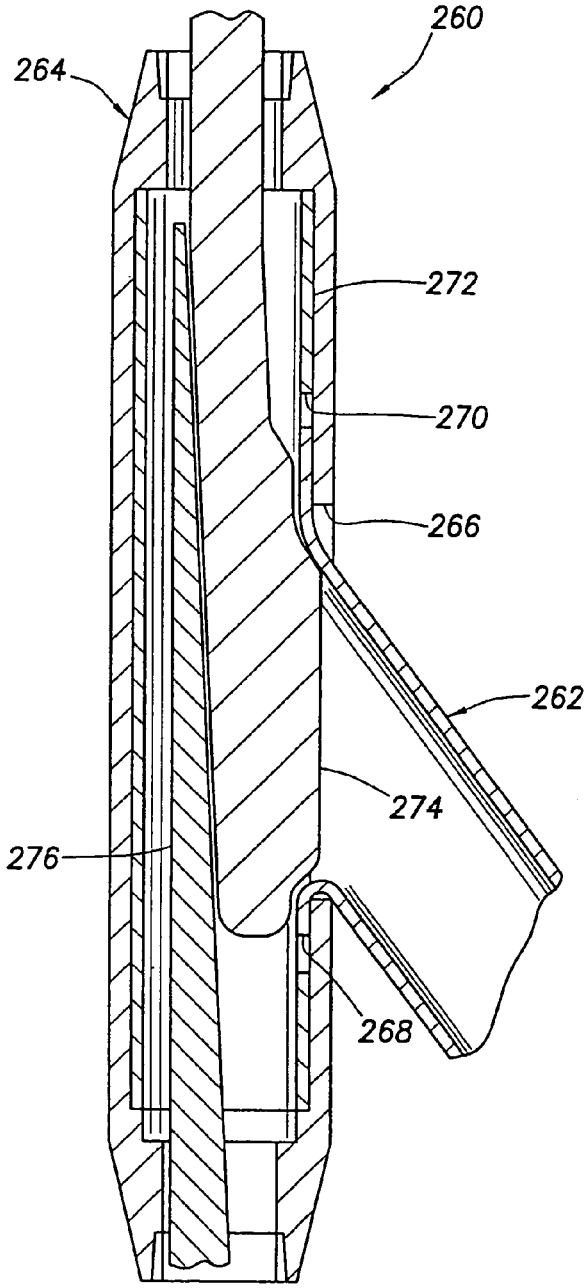

Referring additionally now to FIGS. 26 & 27, another method 260 of sealing and securing a liner string 262 in a branch wellbore to a tubular structure 264 interconnected in a casing string in a parent wellbore is representatively illustrated. Only the structure 264 and liner string 262 are shown in FIG. 26 for illustrative clarity.

In FIG. 26 it may be seen that the liner string 262 is positioned so that it extends outwardly through a window 266 formed through a sidewall of the structure 264. The liner string 262 would, for example, extend into a branch wellbore intersecting the parent wellbore in which the structure 264 is positioned.

An upper end 268 of the liner string 262 remains within the tubular structure 264. To secure the liner string 262 in this position, a packer or other anchoring device interconnected in the liner string may be set in the branch wellbore, or a lower end of the liner string may rest against a lower end of the branch wellbore, etc. Any method of securing the liner string 262 in this position may be used in keeping with the principles of the invention.

As depicted in FIG. 26, the upper end 268 is formed so that it is parallel with a longitudinal axis of the structure 264. The upper end 268 may be formed in this manner prior to conveying the liner string 262 into the well, or the upper end may be formed after the liner string is positioned as shown in FIG. 26, for example, by milling an upper portion of the liner string after it is secured in position. If the upper end 268 is formed prior to conveying the liner string 262 into the well, then the upper end may be rotationally oriented relative to the structure 264 prior to securing the liner string 262 in the position shown in FIG. 26.

In FIG. 27 it may be seen that the upper end 268 of the liner string 262 is deformed radially outward so that it is received in an opening 270 formed through the sidewall of a generally tubular guide structure 272 in the tubular structure 264. The opening 270 is rotationally aligned with the window 266.

The upper end 268 is deformed outward by means of a mandrel 274 which is conveyed into the structure 264 and deflected laterally toward the upper end of the liner string 262 by a deflection device 276. The mandrel 274 shapes the upper end 268 so that it becomes an outwardly extending flange which overlaps the interior of the structure 264 circumscribing the window 266, that is, the flange-shaped upper end 268 inwardly overlies the perimeter of the window.

Preferably, a seal is formed between the flange-shaped upper end 268 and the interior surface of the structure 264 circumscribing the window 266. This seal may be a metal to metal seal, may be formed by a layer of sealing material on one or both of the upper end 268 and the structure 264, etc. Any type of seal may be used in keeping with the principles of the invention.

The flange-shaped upper end 268 also secures the liner string 262 to the structure 264 in that it prevents further outward displacement of the liner string through the window 266. After the deforming process is completed, the mandrel 274 and deflection device 276 may be retrieved from within the structure 264 and a generally tubular expandable member (not shown) may be positioned in the structure and expanded therein. For example, any of the expandable members 82, 148, 186, 222 described above may be used.

After expansion of the member in the structure 264, the member further secures the liner string 262 relative to the structure by preventing inward displacement of the liner string through the window 266. Various seals may also be formed between the expanded member and the structure 264, the flange-shaped upper end 268, and/or the guide structure 272, etc. as described above. Any types of seals may be used in keeping with the principles of the invention.

Figure 28:
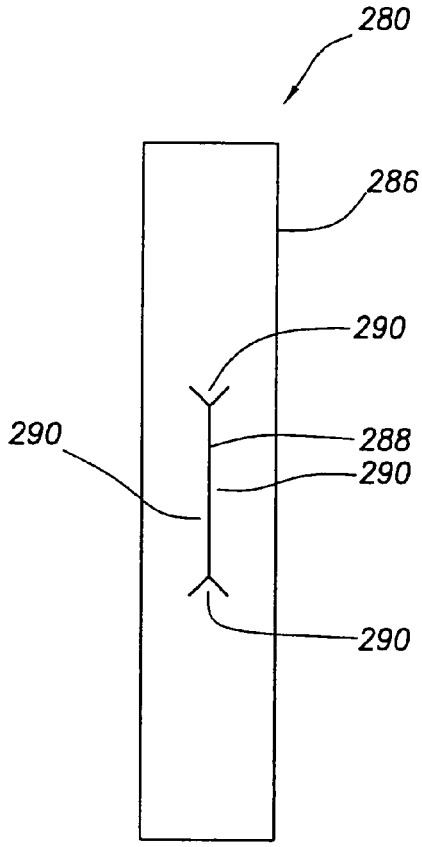
FIGS. 28 & 29 are cross-sectional views of a seventh method embodying principles of the present invention.
Figure 29:
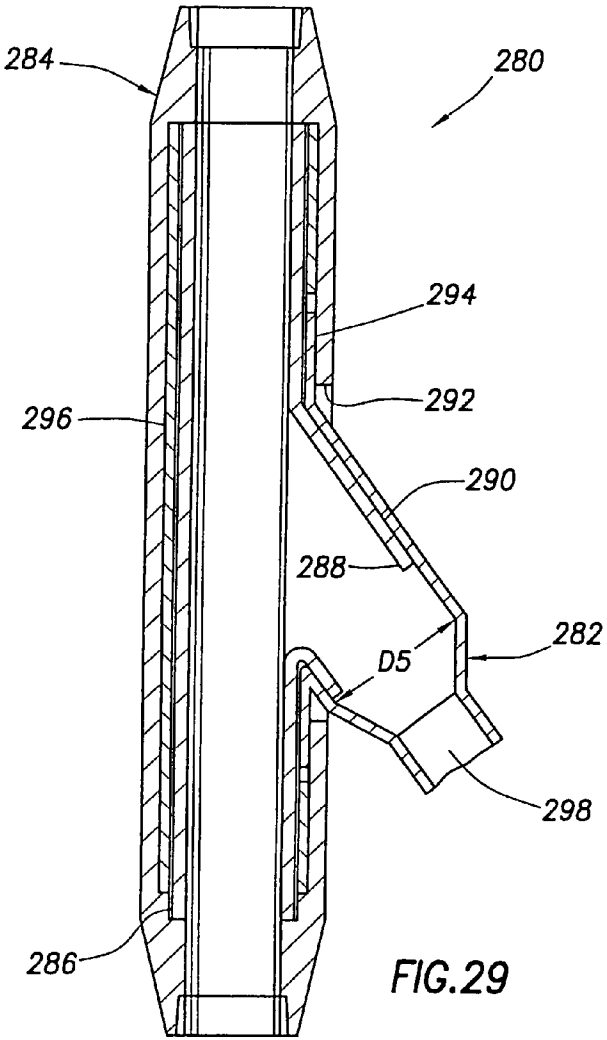

Referring additionally now to FIGS. 28 & 29, another method 280 of sealing and securing a liner string 282 in a branch wellbore to a tubular structure 284 interconnected in a casing string in a parent wellbore is representatively illustrated. In FIG. 28 a generally tubular expandable member 286 used in the method 280 is shown. The member 286 has a specially configured opening 288 formed through a sidewall thereof. The opening 288 may be formed, for example, by waterjet cutting, either before or after it is conveyed into the well.

The configuration of the opening 288 provides multiple inwardly extending flaps or projections 290 which may be folded to enlarge the opening. As depicted in FIG. 29, the opening 288 has been enlarged by folding the projections 290 outward into the interior of the upper end of the liner string 282. The projections 290 are deformed outward, for example, by a mandrel and deflection device such as the mandrel 274 and deflection device 276 described above, but any means of deforming the projections into the liner string 282 may be used in keeping with the principles of the invention.

The projections 290 are deformed outward after the member 286 is positioned within the structure 284, the opening 288 is rotationally aligned with a window 292 formed through a sidewall of the structure, and the member is expanded radially outward. Of course, if the opening 288 is formed after the member 286 is expanded in the structure 284, then the rotational alignment step occurs when the opening is formed.

Expansion of the member 286 secures an upper flange-shaped engagement device 294 relative to the structure 284. Seals may be formed between the member 286, structure 284, engagement device 294 and/or a guide structure 296, etc. as described above. Any types of seals may be used in keeping with the principles of the invention.

Furthermore, deformation of the projections 290 into the liner string 282 may also form a seal between the member 286 and the liner string about the opening 288. For example, a metal to metal seal may be formed by contact between an exterior surface of the member 286 and an interior surface of the liner string 282 when the projections 290 are deformed into the liner string. Other types of seals may be used in keeping with the principles of the invention.

Preferably, the projections 290 are deformed into an enlarged inner diameter D5 of the liner string 282. This prevents the projections 290 from unduly obstructing flow and access through an inner passage 298 of the liner string 282.

Figure 30:
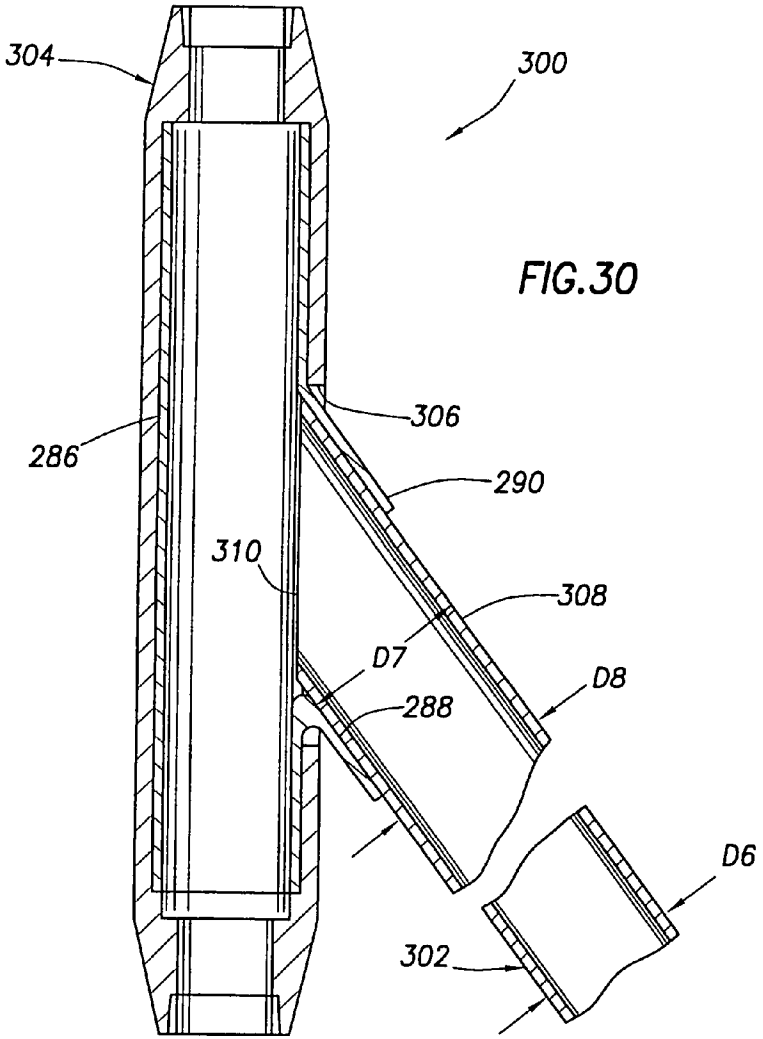
FIG. 30 is a cross-sectional view of an eighth method embodying principles of the present invention.

Referring additionally now to FIG. 30, another method 300 of sealing and securing a liner string 302 in a branch wellbore to a tubular structure 304 interconnected in a casing string in a parent wellbore is representatively illustrated. The method 300 is similar to the method 280 in that it uses an expandable tubular member, such as the member 286 having a specially configured opening 288 formed through its sidewall. However, in the method 300, the member 286 is positioned and expanded radially outward within the structure 304 prior to installing the liner string 302 in the branch wellbore through a window 306 formed through a sidewall of the structure.

Expansion of the member 286 within the structure 304 preferably forms a seal between the outer surface of the member and the inner surface of the structure, at least circumscribing the window 306, and above and below the window. The seal is preferably a metal to metal seal, but other types of seals may be used in keeping with the principles of the invention.

After the member 286 has been expanded within the structure 304, the projections 290 are deformed outward through the window 306. This outward deformation of the projections 290 may result in a seal being formed between the inner surface of the window 306 and the outer surface of the member 286 circumscribing the opening 288. Preferably the seal is a metal to metal seal, but any type of seal may be used in keeping with the principles of the invention.

After the projections 290 are deformed outward through the window 306, the liner string 302 is conveyed into the well and its lower end is deflected through the window 306 and the opening 288, and into the branch wellbore. The vast majority of the liner string 302 has an outer diameter D6 which is less than an inner diameter D7 through the opening 288 and, therefore, passes through the opening with some clearance therebetween. However, an upper portion 308 of the liner string 302 has an outer diameter D8 which is preferably at least as great as the inner diameter D7 of the opening 288. If the diameter D8 is greater than the diameter D7, some additional downward force may be needed to push the upper portion 308 of the liner string 302 through the opening 288. In this case, the liner upper portion 308 may further outwardly deform the projections 290, thereby enlarging the opening 288, as it is pushed through the opening.

Contact between the outer surface of the liner upper portion 308 and the inner surface of the opening 288 may cause a seal to be formed therebetween circumscribing the opening. Preferably, the seal is a metal to metal seal, but other seals may be used in keeping with the principles of the invention. An upper end 310 of the liner string 302 may be cut off as shown in FIG. 30, so that it does not obstruct flow or access through the structure 304. Alternatively, the upper end 310 may be formed prior to conveying the liner string 302 into the well.

Figure 31:
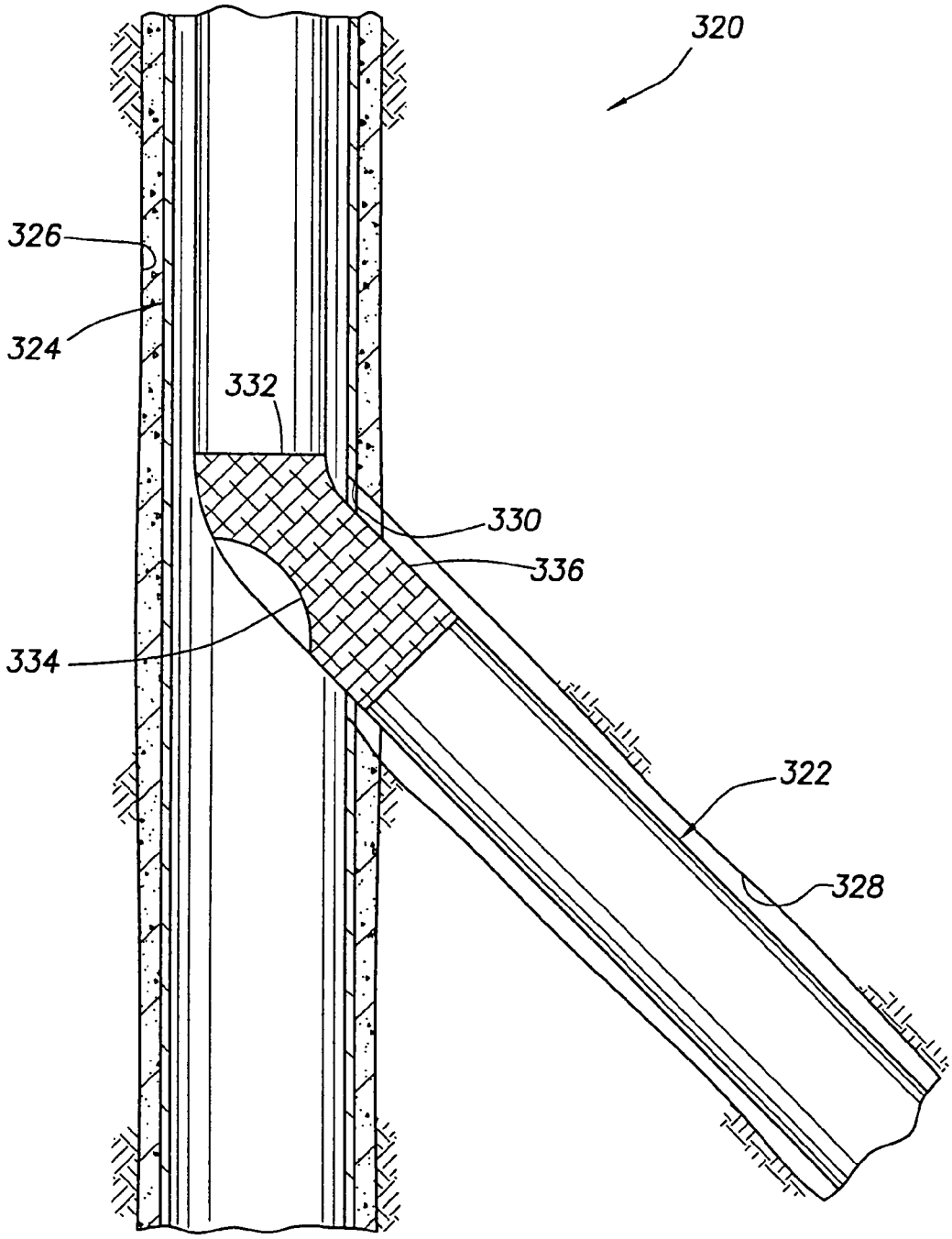
FIGS. 31–35 are cross-sectional views of a ninth method embodying principles of the present invention.

Referring additionally now to FIGS. 31–35, another method 320 embodying principles of the invention is representatively illustrated. In FIG. 31 it may be seen that a liner string 322 is conveyed through a casing string 324 in a parent wellbore 326, and a lower end of the liner string is deflected laterally through a window 330 formed through a sidewall of the casing string, and into a branch wellbore 328. The casing string 324 may or may not be cemented in the parent wellbore 326 at the time the liner string 322 is installed in the method 320.

The liner string 322 includes a portion 332 which has an opening 334 formed through a sidewall thereof. In addition, an external layer of sealing material 336 is disposed on the liner portion 332. The sealing material 336 may be, for example, an elastomer, an adhesive, a relatively soft metal, or any other type of sealing material. Preferably, the sealing material 336 outwardly circumscribes the opening 334 and extends circumferentially about the liner portion 332 above and below the opening.

The liner string 322 is positioned as depicted in FIG. 31, with the liner portion 332 extending laterally across the interior of the casing string 324 and the opening 334 facing downward. However, it is to be clearly understood that it is not necessary for the opening 334 to exist in the liner portion 332 prior to the liner string 322 being conveyed into the well. Instead, the opening 334 could be formed downhole, for example, by using a cutting tool and guide, such as the cutting tool 250 and guide 248 described above. As another alternative, the opening 334 may be specially configured (such as the opening 254 depicted in FIG. 24), and then enlarged (as depicted for the opening 254 in FIG. 25).

Figure 32:
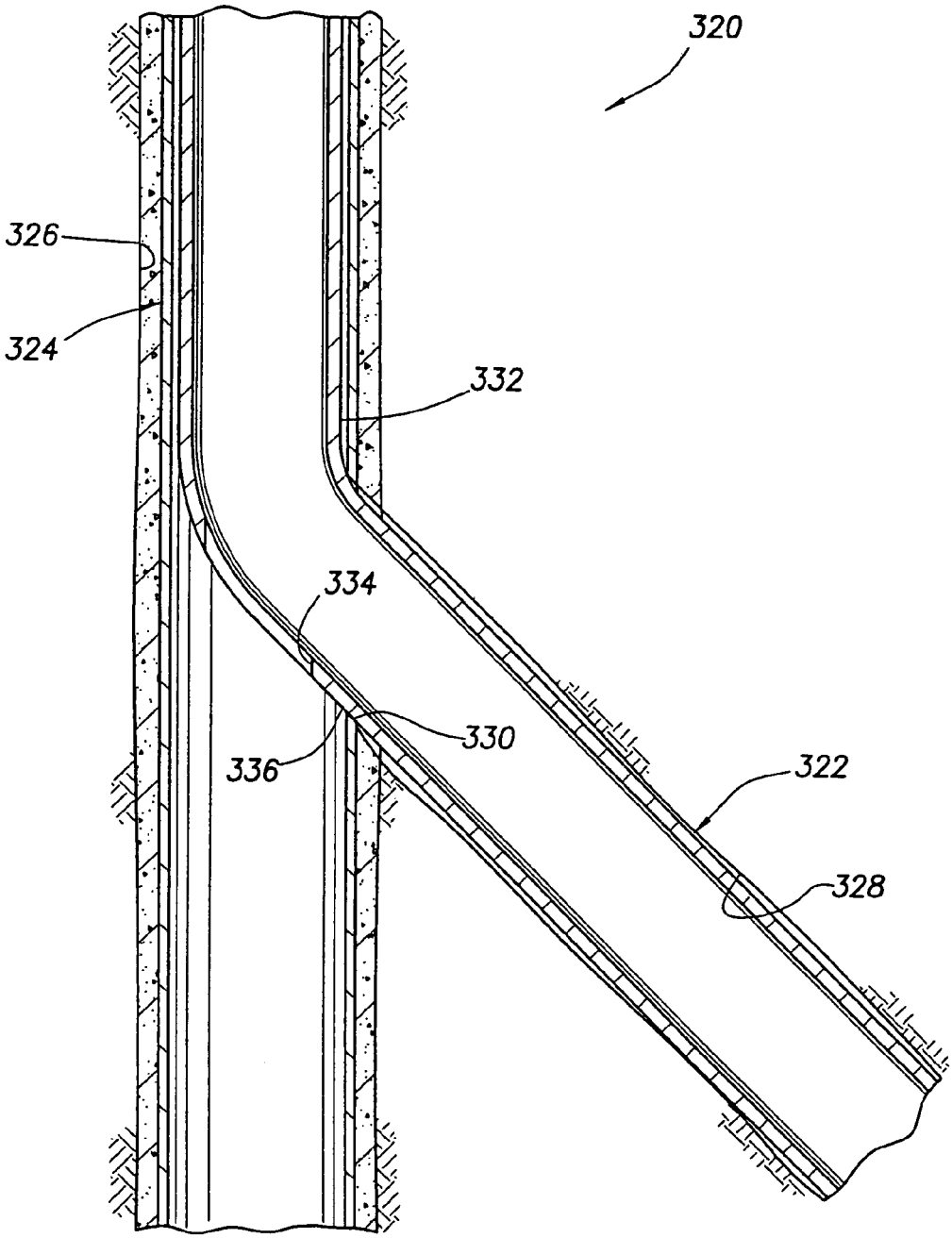

In FIG. 32 it may be seen that the liner string 322 is expanded radially outward. Preferably, at least the liner portion 332 is expanded, but the remainder of the liner string 322 may also be expanded. Due to expansion of the liner portion 332, the outer surface of the liner portion contacts and seals against the inner surface of the window 330 circumscribing the window. The seal between the liner portion 332 and the window 330 is facilitated by the sealing material 336 contacting the inner surface of the window. However, the seal could be formed by other means, such as metal to metal contact between the liner portion 332 and the window 330, without use of the sealing material 336, in keeping with the principles of the invention.

Figure 33:
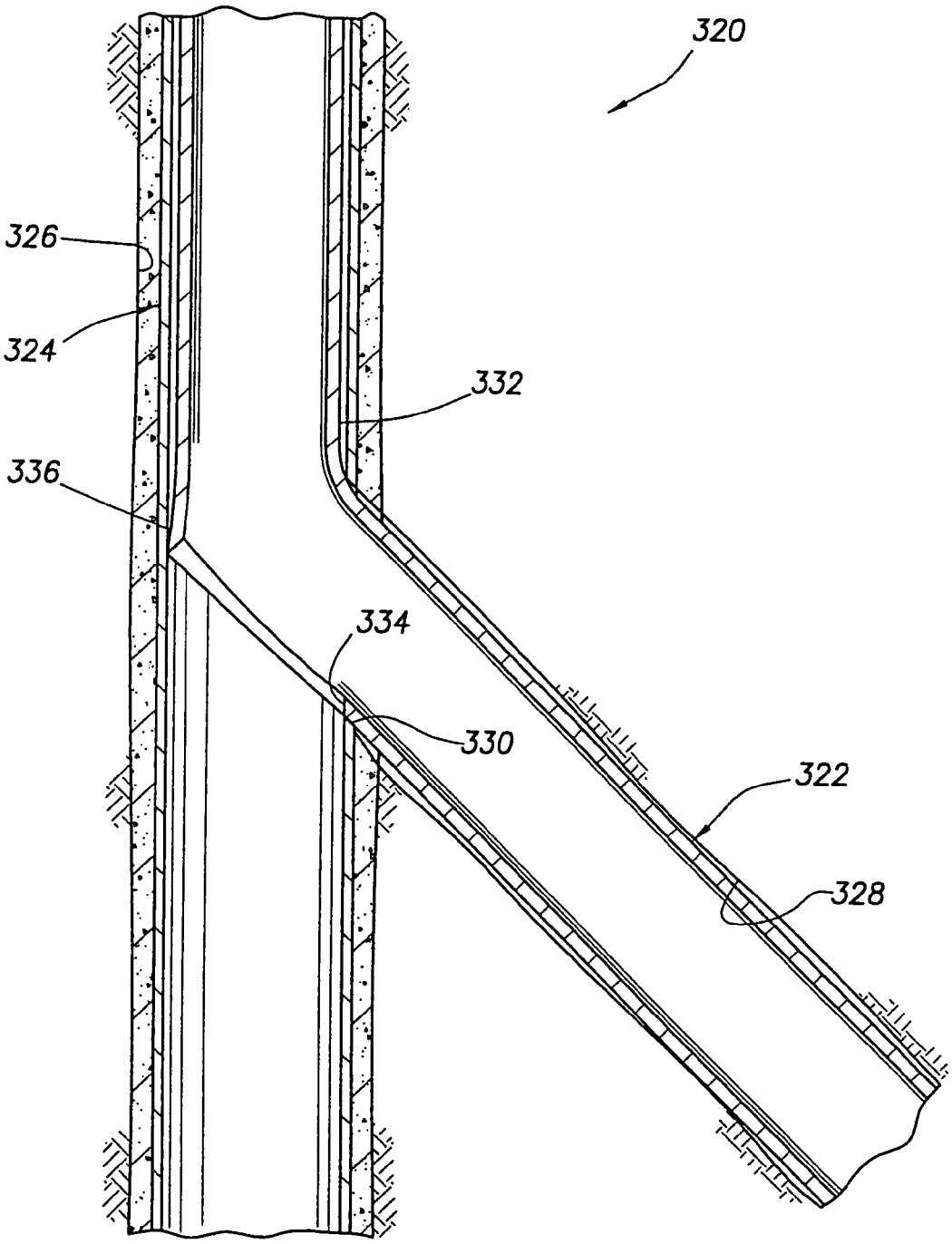

In FIG. 33 it may be seen that the opening 334 is expanded to provide enhanced flow and access between the interior of the casing string 324 below the window 330 and the interior of the liner string 322 above the window. Expansion of the opening 334 also results in a seal being formed between the exterior surface of the liner portion 332 circumscribing the opening 334 and the interior of the casing string 324. At this point, it will be readily appreciated that the interiors of the casing and liner strings 324, 322 are isolated from the wellbores 326, 328 external to the strings.

Figure 34:
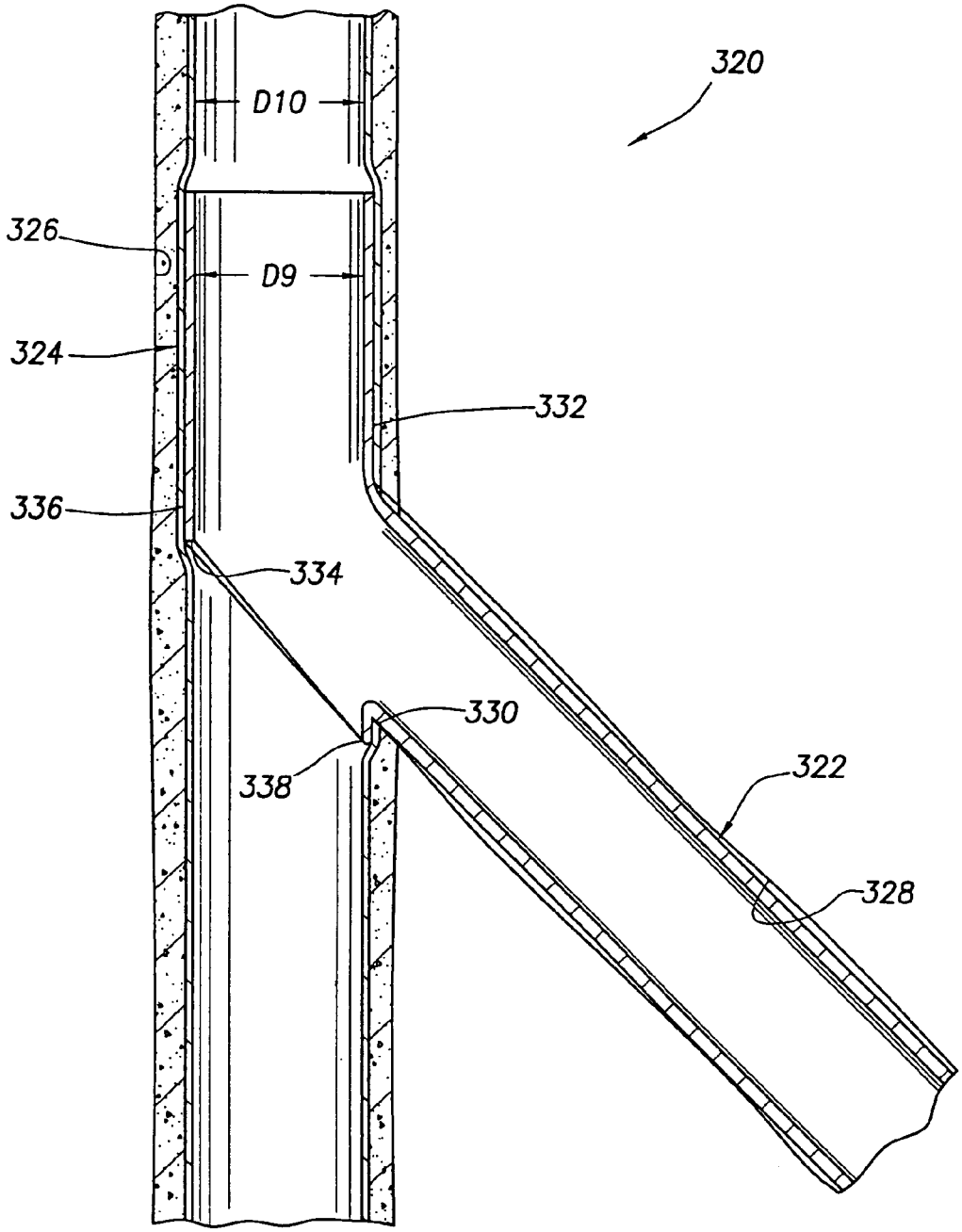

Additional steps in the method 320 may be used to further seal and secure the connection between the liner and casing strings 322, 324. In FIG. 34 it may be seen that the liner string 322 within the casing string 324 is further outwardly expanded so that it contacts and radially outwardly deforms the casing string. The opening 334 is also further expanded, and a portion 338 of the liner string 322 may be deformed downwardly into the casing string 324 as the opening is expanded.

This further expansion of the liner string 322, including the opening 334, in the casing string 324 produces several desirable benefits. The liner string 322 is recessed into the inside wall of the casing string 324, thereby providing an inner diameter D9 in the liner string which is preferably substantially equal to, or at least as great as, an inner diameter D10 of the casing string 324 above the window 330. The seal between the outer surface of the liner string 322 circumscribing the opening 334 and the inner surface of the casing string 324 is enhanced by increased contact pressure therebetween. In addition, another seal may be formed between the outer surface of the liner string 322 and the inner surface of the casing string 324 above the window 330. Furthermore, the downward deformation of the portion 338 into the casing string 324 below the window 330 enhances the securement of the liner string 322 to the casing string. As described above, outward elastic deformation of the casing string 324 may be desirable to induce an inwardly biasing force on the casing string when the expansion force is removed, thereby maintaining a relatively high level of contact pressure between the casing and liner strings 324, 322.

Figure 35:
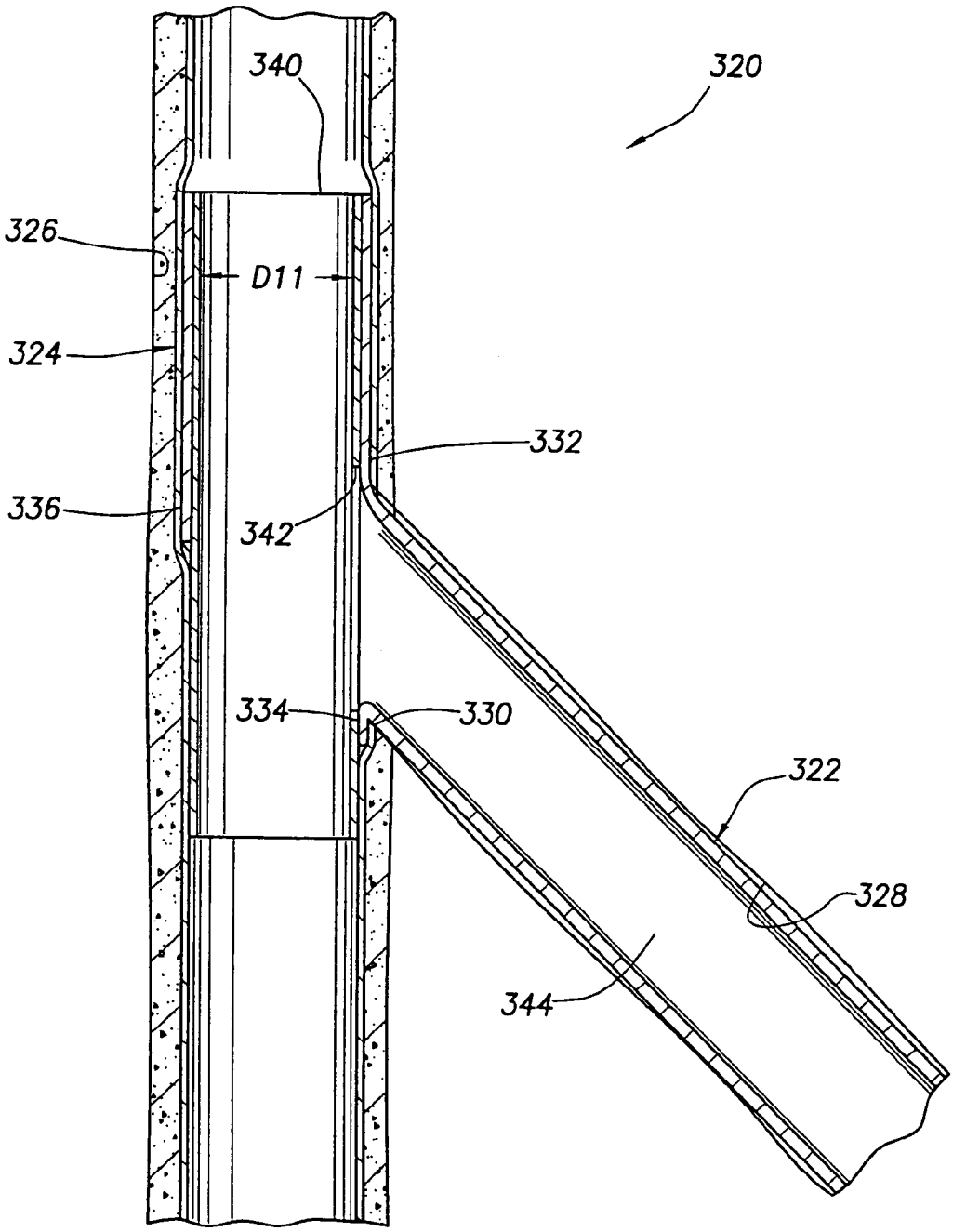

In FIG. 35 it may be seen that a generally tubular expandable member 340 having an opening 342 formed through a sidewall thereof is positioned within the casing string 324 with the opening 342 rotationally aligned with the window 330 and, thus, with a flow passage 344 of the liner string 322. The member 340 extends above and below the liner string 322 in the casing string 324 and extends through the opening 334. The member 340 is then expanded radially outward within the casing string 324.

Expansion of the member 340 further secures the connection between the liner and casing strings 322, 324. Seals may be formed between the outer surface of the member 340 and the interior surface of the casing string 324 above and below the liner string 322, and the inner surface of the liner string in the casing string. The seals are preferably formed due to contact between the member 340 outer surface and the casing and liner strings 324, 322 inner surfaces. For example, the seals may be metal to metal seals. The seals may be formed due to a layer of sealing material on the member 340 outer surface and/or the casing and liner strings 324, 322 inner surfaces. However, any types of seals may be used in keeping with the principles of the invention.

The member 340 may be further expanded to further outwardly deform the casing string 324 where it overlies the member, in a manner similar to that used to expand the member 186 in the method 170 as depicted in FIG. 17. In that way, the member 340 may be recessed into the inner wall of the casing string 324 and the inner diameter D11 of the member may be enlarged so that it is substantially equal to, or at least as great as, the inner diameter D10 of the casing string. Due to outward deformation of the casing string 324 in the method 320, whether or not the member 340 is recessed into the inner wall of the casing string, it may be desirable to delay cementing of the casing string in the parent wellbore 326 until after the expansion process is completed.

Thus have been described the methods 10, 110, 170, 200, 230, 260, 280, 300, 320 which provide improved connections between tubular strings in a well. It should be understood that openings and windows formed through sidewalls of tubular members and structures described herein may be formed before or after the tubular members and structures are conveyed into a well. Also, it should be understood that casing and/or liner strings may be cemented in parent or branch wellbores at any point in the methods described above.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, although certain seals have been described above as being carried on one element for sealing engagement with another element, it will be readily appreciated that seals may be carried on either or neither element. Accordingly, the foregoing detailed description is to be clearly understood as being given by way of illustration and example only, the spirit and scope of the present invention being limited solely by the appended claims and their equivalents.

What is claimed is:

1. A method of forming a wellbore junction in a subterranean well, the method comprising the steps of:

drilling a first wellbore; installing a casing string in the first wellbore;

drilling a second wellbore extending outwardly from the first wellbore;

aligning a window formed through a sidewall of the casing string with the second wellbore;

installing a liner string through the window and into the second wellbore; and then installing a member within the casing string, thereby preventing the liner string from displacing inwardly through the window, wherein the member is absent from the casing string prior to the liner string installing step.

2. A method of forming a wellbore junction in a subterranean well, the method comprising the steps of:

drilling a first wellbore;

installing a casing string in the first wellbore;

drilling a second wellbore extending outwardly from the first wellbore;

aligning a window formed through a sidewall of the casing string with the second wellbore;

installing a liner string through the window and into the second wellbore;

then positioning a member within the casing string, thereby preventing the liner string from displacing inwardly through the window; and forming an opening through a sidewall of the member, the opening having projections extending into the opening.

3. The method according to claim 2, wherein the forming step is performed after the liner string installing step.

4. The method according to claim 2, wherein the forming step is performed before the liner string installing step, and wherein the positioning step further comprises aligning the opening with the window.

5. A method of forming a wellbore junction in a subterranean well, the method comprising the steps of:

drilling a first wellbore;

installing a casing string in the first wellbore;

drilling a second wellbore extending outwardly from the first wellbore;

aligning a window formed through a sidewall of the casing string with the second wellbore;

installing a liner string through the window and into the second wellbore;

then positioning a member within the casing string, thereby preventing the liner string from displacing inwardly through the window;

forming an opening through a sidewall of the member, the opening having projections extending into the opening; and enlarging the opening after the positioning step.

6. The method according to claim 5, wherein the enlarging step further comprises folding the projections outward into the window.

7. The method according to claim 5, wherein the enlarging step further comprises folding the projections outward into an end portion of the liner string.

8. The method according to claim 7, wherein the folding step further comprises folding the projections into an enlarged diameter portion of the liner string end portion.

9. The method according to claim 8, wherein the enlarging step further comprises enlarging an inner dimension of the opening so that the opening inner dimension is greater than or equal to an inner diameter of the liner string.

10. The method according to claim 5, wherein the enlarging step further comprises sealing between the member and the liner string about the opening.

11. The method according to claim 10, wherein the sealing step further comprises forming a metal to metal seal between the member and the liner string.

12. The method according to claim 10, wherein the sealing step further comprises positioning a sealing material between the member and the liner string.

13. The method according to claim 10, wherein the sealing step further comprises isolating an interior of the casing string from the first and second wellbores external to the casing string.

14. The method according to claim 5, wherein the enlarging step further comprises conveying a deflection device and mandrel into the casing string, and displacing the mandrel relative to the deflection device, thereby laterally deflecting the mandrel to displace the projections outward.

15. A method of forming a wellbore junction in a subterranean well, the method comprising the steps of:

drilling a first wellbore;

installing a casing string in the first wellbore;

drilling a second wellbore extending outwardly from the first wellbore;

aligning a window formed through a sidewall of the casing string with the second wellbore;

installing a liner string through the window and into the second wellbore;

then positioning a member within the casing string, thereby preventing the liner string from displacing inwardly through the window, the positioning step further comprising expanding the member within the casing string; and enlarging an opening formed through a sidewall of the member after the expanding step.

16. The method according to claim 15, wherein the enlarging step is performed after the expanding step.

17. The method according to claim 15, further comprising the step of forming the opening through the member sidewall after the expanding step.

18. The method according to claim 15, further comprising the step of forming the opening through the member sidewall before the expanding step.

19. The method according to claim 15, wherein in the liner string installing step, a flange formed on an end portion of the liner string prevents the liner string from displacing further outward through the window.

20. The method according to claim 19, wherein the opening enlarging step further comprises providing projections extending into the opening, and folding the projections outward into the liner string flange.

21. The method according to claim 19, wherein the folding step further comprises sealing between the member and the liner string end portion.

22. The method according to claim 21, wherein the sealing step further comprises forming a metal to metal seal between the member and the liner string end portion about the opening.

23. The method according to claim 21, wherein the sealing step further comprises positioning a sealing material between the member and the liner string end portion about the opening.

24. The method according to claim 21, wherein the sealing step further comprises isolating an interior of the casing string from the first and second wellbores external to the casing string.

25. The method according to claim 19, wherein the liner string installing step further comprises forming the flange on the liner string end portion after conveying the liner string into the casing string.

26. The method according to claim 25, wherein the flange forming step further comprises sealing between the flange and the casing string about the window.

27. The method according to claim 26, wherein the sealing step further comprises forming a metal to metal seal between the flange and the casing string about the window.

28. The method according to claim 26, wherein the sealing step further comprises providing a sealing material between the flange and the casing string about the window.

29. The method according to claim 26, wherein the sealing step further comprises isolating an interior of the casing string from the first and second wellbores external to the casing string.

30. The method according to claim 19, wherein the expanding step further comprises sealing between the member and the flange.

31. The method according to claim 30, wherein the sealing step further comprises forming a metal to metal seal between the flange and the member.

32. The method according to claim 30, wherein the sealing step further comprises providing a sealing material between the flange and the member.

33. The method according to claim 30, wherein the sealing step further comprises isolating an interior of the casing string from the first and second wellbores external to the casing string.

34. The method according to claim 15, wherein the member expanding step further comprises sealing between the member and the casing string.

35. The method according to claim 34, wherein the sealing step further comprises forming a metal to metal seal between the member and the casing string.

36. The method according to claim 34, wherein the sealing step further comprises providing a sealing material between the member and the casing string.

37. The method according to claim 34, wherein the sealing step further comprises isolating an interior of the casing string from the first and second wellbores external to the casing string.

38. The method according to claim 15, wherein the member expanding step further comprises sealing between the member and the liner string.

39. The method according to claim 38, wherein the sealing step further comprises forming a metal to metal seal between the member and the liner string.

40. The method according to claim 38, wherein the sealing step further comprises providing a sealing material between the member and the liner string.

41. The method according to claim 38, wherein the sealing step further comprises isolating an interior of the casing string from the first and second wellbores external to the casing string.

* * * * *